US010626485B2

(12) United States Patent
Obata et al.

(10) Patent No.: US 10,626,485 B2
(45) Date of Patent: Apr. 21, 2020

(54) THIN HIGH-STRENGTH COLD-ROLLED STEEL SHEET AND METHOD OF PRODUCING THE SAME

(71) Applicant: JFE Steel Corporation, Tokyo (JP)

(72) Inventors: Yoshie Obata, Chiba (JP); Yoshiyasu Kawasaki, Chiba (JP); Keiji Ueda, Kurashiki (JP); Shinjiro Kaneko, Chiba (JP); Takeshi Yokota, Kawasaki (JP); Kazuhiro Seto, Chiba (JP)

(73) Assignee: JFE Steel Corporation, Tokyo (JP)

( * ) Notice: Subject to any disclaimer, the term of this patent is extended or adjusted under 35 U.S.C. 154(b) by 233 days.

(21) Appl. No.: 15/551,301

(22) PCT Filed: Jan. 25, 2016

(86) PCT No.: PCT/JP2016/000339
§ 371 (c)(1),
(2) Date: Aug. 16, 2017

(87) PCT Pub. No.: WO2016/132680
PCT Pub. Date: Aug. 25, 2016

(65) Prior Publication Data

US 2018/0057916 A1 Mar. 1, 2018

(30) Foreign Application Priority Data

Feb. 17, 2015 (JP) ..... 2015-028304

(51) Int. Cl.

| | |
|---|---|
| ***C21D 9/46*** | (2006.01) |
| ***C22C 38/14*** | (2006.01) |
| ***C21D 8/02*** | (2006.01) |
| ***C23C 2/06*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/60*** | (2006.01) |
| ***C22C 38/00*** | (2006.01) |
| ***C22C 38/18*** | (2006.01) |
| ***C22C 38/16*** | (2006.01) |
| ***C23C 2/02*** | (2006.01) |
| ***C23C 2/40*** | (2006.01) |

(52) U.S. Cl.
CPC ..... *C22C 38/14* (2013.01); *C21D 8/0236* (2013.01); *C21D 8/0268* (2013.01); *C21D 9/46* (2013.01); *C22C 38/00* (2013.01); *C22C 38/001* (2013.01); *C22C 38/02* (2013.01); *C22C 38/04* (2013.01); *C22C 38/06* (2013.01); *C22C 38/12* (2013.01); *C22C 38/16* (2013.01); *C22C 38/18* (2013.01); *C22C 38/60* (2013.01); *C23C 2/02* (2013.01); *C23C 2/06* (2013.01); *C23C 2/40* (2013.01); *C21D 2211/001* (2013.01); *C21D 2211/004* (2013.01); *C21D 2211/005* (2013.01); *C21D 2211/008* (2013.01); *C21D 2211/009* (2013.01)

(58) Field of Classification Search
CPC ..... C21D 2211/001; C21D 2211/005; C21D 2211/008; C21D 8/0236; C21D 9/46; C22C 38/00; C23C 2/02; C23C 2/06; C23C 2/40
USPC ..... 148/337
See application file for complete search history.

(56) References Cited

U.S. PATENT DOCUMENTS

| | | | | |
|---|---|---|---|---|
| 9,540,720 | B2 * | 1/2017 | Azuma | C23C 2/06 |
| 9,551,055 | B2 * | 1/2017 | Sato | C23C 2/02 |
| 2014/0227556 | A1 | 8/2014 | Sato et al. | |
| 2015/0027597 | A1 | 1/2015 | Liu et al. | |
| 2015/0034219 | A1 | 2/2015 | Kawabe et al. | |

FOREIGN PATENT DOCUMENTS

| | | | |
|---|---|---|---|
| CN | 103797145 | | 5/2014 |
| CN | 104126023 | | 10/2014 |
| EP | 2 243 852 | A1 | 10/2010 |
| EP | 2 757 169 | | 7/2014 |
| EP | 2 998 416 | | 3/2016 |
| JP | 2007-154283 | A | 6/2007 |
| JP | 4325998 | B2 | 6/2009 |
| JP | 2011-190474 | A | 9/2011 |
| JP | 2012-153957 | A | 8/2012 |

(Continued)

OTHER PUBLICATIONS

Chinese Office Action dated May 4, 2018, of corresponding Chinese Application No. 2016800100577, along with a Search Report in English.

(Continued)

*Primary Examiner* — Jie Yang
(74) *Attorney, Agent, or Firm* — DLA Piper LLP (US)

(57) ABSTRACT

A steel having a composition containing C: more than 0.20% and 0.45% or less, Si: 0.50% to 2.50%, Mn: 2.00% or more and less than 3.50%, and one or two selected from Ti: 0.005% to 0.100% and Nb: 0.005% to 0.100% is hot-rolled and cold-rolled. The steel sheet is heated to 800° C. to 950° C. and cooled to a cooling-end temperature of 350° C. to 500° C. at a cooling rate of 5° C./s or more to form a steel sheet having a microstructure including martensite and bainite phases such that the total proportion of the martensite and bainite phases is 80% or more by volume. The steel sheet is heated to 700° C. to 840° C. and maintained at 700° C. to 840° C., cooled to a cooling-end temperature of 350° C. to 500° C. at a cooling rate of 5 to 50° C./s, and maintained within the above temperature range for 10 to 1800 s.

8 Claims, No Drawings

(56) References Cited

FOREIGN PATENT DOCUMENTS

| | | | |
|---|---|---|---|
| JP | 5321765 | B1 | 7/2013 |
| JP | 2013-185196 | A | 9/2013 |
| KR | 10-2005-0068249 | | 7/2005 |
| KR | 10-2010-0101691 | A | 9/2010 |
| WO | 2013/047808 | A1 | 4/2013 |
| WO | 2015/015739 | | 2/2015 |
| WO | 2015/151419 | A1 | 10/2015 |

OTHER PUBLICATIONS

Supplementary European Search Report dated Oct. 11, 2017, of corresponding European Application No. 16752073.3.
Japanese Office Action dated Apr. 18, 2017, of corresponding Japanese Application No. 2016-530252, along with a Concise Statement of Relevance of Office Action in English.
Korean Office Action dated Oct. 5, 2018, of counterpart Korean Application No. 10-2017-7022367, along with a Concise Statement of Relevance of Office Action in English.
Korean Grant of Patent dated Mar. 8, 2019, of counterpart Korean Application No. 10-2017-7022367, along with an English translation.
Chinese Office Action dated Oct. 17, 2018, of counterpart Chinese Application No. 201680010057.7, along with a Search Report in English.

* cited by examiner

THIN HIGH-STRENGTH COLD-ROLLED STEEL SHEET AND METHOD OF PRODUCING THE SAME

TECHNICAL FIELD

This disclosure relates to a thin high-strength cold-rolled steel sheet having a tensile strength TS of 980 MPa or more, which is suitably used to produce automotive components, and a method of producing the thin high-strength cold-rolled steel sheet and specifically to reductions in in-plane anisotropies of the steel sheet in terms of strength and elongation and improvement of consistency in the production of the steel sheet.

BACKGROUND

There has been a demand for improving the fuel economy of automobiles from the viewpoint of global environmental protection. Accordingly, high-strength steel sheets having a tensile strength of 980 MPa or more have been increasingly used to produce automotive components and the like. There has also been an increasing demand to improve collision safety of automobiles. High-strength steel sheets have been widely used as a structural member of automotive body frames or the like to ensure the safety of vehicle occupants at the time of impact. Application of high-strength steel sheets having a markedly high tensile strength of the 1180 MPa grade or the 1270 MPa grade has been studied.

For example, Japanese Unexamined Patent Application Publication No. 2012-153957 describes a method of producing a high-strength cold-rolled steel sheet, in which a slab having a composition containing, by mass, C: 0.16% to 0.20%, Si: 1.0% to 2.0%, Mn: 2.5% to 3.5%, Al: 0.005% to 0.1%, N: 0.01% or less, Ti: 0.001% to 0.050%, and B: 0.0001% to 0.0050% is hot-rolled, pickled, and subsequently cold-rolled and, in an annealing step, the resulting cold-rolled steel sheet is annealed at 800° C. to 950° C., subsequently cooled to a cooling-end temperature of 200° C. to 500° C., reheated to 750° C. to 850° C., then cooled to a cooling-end temperature range of 350° C. to 450° C. at an average cooling rate of 5 to 50° C./s, and held within the above temperature range for 100 to 1000 s to form a high-strength cold-rolled steel sheet having excellent ductility and a tensile strength of 1180 MPa or more. According to the technique described in JP '957, it is possible to produce a high-strength cold-rolled steel sheet having a microstructure including, by volume, ferrite phase: 40% to 65%, martensite phase: 30% to 55%, and retained austenite phase: 5% to 15% in which the number of crystal grains of the martensite phase per unit area of 1 $\mu m^2$ in the rolling-direction cross section is 0.5 to 5.0, excellent ductility, a tensile strength of 1180 MPa or more, and a strength-ductility balance TS×El of 22000 MPa % or more.

Japanese Patent No. 4325998 describes a high-strength hot-dip galvanized steel sheet having a composition containing, by mass, C: 0.05% to 0.12%, Si: 0.05% or less, Mn: 2.7% to 3.5%, Cr: 0.2% to 0.5%, and Mo: 0.2% to 0.5% in which the Al, P, and S contents are limited to be Al: 0.10% or less, P: 0.03% or less, and S: 0.03% or less and a composite microstructure primarily composed of ferrite and martensite. The high-strength hot-dip galvanized steel sheet has a tensile strength of 780 to 1180 MPa, excellent spot weldability, and excellent quality consistency. According to the technique described in JP '998, reducing the C content to 0.05% to 0.12% improves spot weldability. Furthermore, adding Cr and Mo, as essential components, to the steel sheet limits the fluctuations in yield strength to be 18 MPa or less, the fluctuations in tensile strength to be 13 MPa or less, and fluctuations in total elongation to be 1.8% or less. This enables a steel sheet having excellent spot weldability and excellent quality consistency to be produced.

Japanese Patent No. 5321765 discloses a method of producing a high-strength hot-dip galvanized steel sheet, in which a steel slab having a composition containing, by mass, C: 0.10% to less than 0.4%, Si: 0.5% to 3.0%, and Mn: 1.5% to 3.0% in which the 0, P, S, Al, and N contents are limited to be: O 0.006% or less, P: 0.04% or less, S: 0.01% or less, Al: 2.0% or less, and N: 0.01% or less, with the balance including iron and inevitable impurities is subjected to first hot rolling in which the steel slab is rolled one or more times at 1000° C. to 1200° C. with a rolling reduction of 40% or more to control the diameter of austenite grains to be 200 μm or less; the resulting hot-rolled steel sheet is subjected to second hot rolling in which the hot-rolled steel sheet is rolled at least once with a rolling reduction of 30% or more per path at T1+30° C. or more and T1+200° C. or less, where T1 is a temperature determined using a specific relational expression with respect to the contents of constituents of the steel slab such that the total rolling reduction achieved in second hot rolling is 50% or more; after final rolling has been performed at a rolling reduction of 30% or more in second hot rolling, the hot-rolled steel sheet is subjected to pre-cold-roll cooling such that the amount of waiting time t [sec] satisfies $t \leq 2.5 \times t1$, wherein the average cooling rate in pre-cold-roll cooling is 50° C./sec or more, and a change in temperature which occurs in pre-cold-roll cooling is 40° C. to 140° C.; after the cooled steel sheet has been coiled at 700° C. or less, it is cold-rolled at a rolling reduction of 40% to 80%; and, in a continuous hot-dip galvanizing line, the cold-rolled steel sheet is heated to an annealing temperature of 750° C. to 900° C., subsequently cooled from the annealing temperature to 500° C. at 0.1 to 200° C./sec, held at 500° C. to 350° C. for 10 to 1000 seconds, and then subjected to hot-dip galvanizing to produce a high-strength hot-dip galvanized steel sheet having a tensile strength of 980 MPa or more, small anisotropies in terms of properties, and excellent formability. According to the technique described in JP '765, using Si, which is a strengthening element, makes it possible to produce a high-strength hot-dip galvanized steel sheet having small anisotropies in terms of qualities and excellent formability which includes, by volume, 40% or more ferrite, 8% or more and less than 60% retained austenite, and the balance including bainite or martensite, wherein the average pole density of the {100}<011> to {223}<110> orientations is 6.5 or less and the pole density of the {332}<113> crystallographic orientation is 5.0 or less.

However, reducing the thickness of a steel sheet while increasing the strength of the steel sheet as described above may significantly deteriorate the shape fixability of a product formed by pressing the steel sheet into a shape. Accordingly, dies used in press forming have been commonly designed with consideration of the estimated amount of change in the shape of the product that occurs when the product is released from the dies. However, if the strength and ductility of the same type of steel sheet vary individually, the amount of change in the shape of each product may significantly deviate from the amount of change which is estimated assuming that the strength and ductility of the steel sheets are uniform. As a result, shape defects may occur. This results in the necessity to make adjustments, by sheet-metal working or the like, to each of the products formed by press-forming and significantly reduces the mass production efficiency. For the above reasons, a high-strength steel sheet having excellent production consistency that enables fluctuations in the strength and elongation of products formed of the same type of steel sheet to be minimized, and small in-plane anisotropies is required.

However, the technique described in JP '957 does not consider the production consistency or the in-plane anisotropies. According to JP '998, the tensile strength TS of the steel sheet is 980 MPa or more and the total elongation El of the steel sheet is less than 15%. That is, the technique described in JP '998 is not capable of markedly improving ductility. In addition, no consideration is given to in-plane anisotropies. In the technique described in JP '765, no consideration is given to production consistency.

It could therefore be helpful to provide a thin high-strength cold-rolled steel sheet having a high strength, high ductility, small fluctuations in strength and elongation with the temperature at which an annealing treatment is performed, excellent production consistency, and small in-plane anisotropies in terms of strength and elongation and a method of producing the thin high-strength cold-rolled steel sheet. The term "high strength" used herein refers to having a tensile strength TS of 980 MPa or more. The term "high ductility" used herein refers to having a total elongation El (measured using a JIS No. 5 tensile test specimen (GL: 50 mm)) of 20% or more when TS: 980 MPa grade, 15% or more when TS: 1180 MPa grade, and 10% or more when TS: 1270 MPa grade. The term "excellent production consistency" used herein refers to fluctuations in the tensile strength TS and total elongation El of the steel sheet per 20° C. of change in temperature at which an annealing step is conducted being 25 MPa or less and 5% or less, respectively.

The term "small in-plane anisotropies" used herein refers to δTS defined by Expression (1) below being 25 MPa or less, $$\delta TS=(TS_L+TS_C-2\times TS_D)/2 \quad (1)$$

(where $TS_L$: tensile strength (MPa) in a direction (L direction) parallel to the rolling direction, $TS_C$: tensile strength (MPa) in a direction (C direction) perpendicular to the rolling direction, and $TS_D$: tensile strength (MPa) in a direction (D direction) inclined at an angle of 45° with respect to the rolling direction), and δEl defined by Expression (2) below being 10% or less, $$\delta El=(EL_L+El_C-2\times El_D)/2 \quad (2)$$

(where $EL_L$: total elongation (%) in a direction (L direction) parallel to the rolling direction, $El_C$: total elongation (%) in a direction (C direction) perpendicular to the rolling direction, and $El_D$: total elongation (%) in a direction (D direction) inclined at an angle of 45° with respect to the rolling direction).

The term "thin steel sheet" used herein refers to a steel sheet having a thickness of 5 mm or less.

SUMMARY

We thus provide:

(1) A thin high-strength cold-rolled steel sheet including a composition containing, by mass, C: more than 0.20% and 0.45% or less, Si: 0.50% to 2.50%, Mn: 2.00% or more and less than 3.50%, P: 0.001% to 0.100%, S: 0.0200% or less, N: 0.0100% or less, Al: 0.01% to 0.100%, and one or two elements selected from Ti: 0.005% to 0.100% and Nb: 0.005% to 0.100%, the balance being Fe and inevitable impurities, and a microstructure including, by volume, 15% or more and 70% or less ferrite phase and more than 15% and 40% or less retained austenite phase, the balance being 30% or less (not including 0%) martensite phase or including 30% or less (not including 0%) martensite phase and 10% or less (including 0%) pearlite phase and/or carbide, wherein crystal grains of the retained austenite phase have an average diameter of 2.0 μm or less and an aspect ratio of 2.0 or more, a tensile strength of the thin high-strength cold-rolled steel sheet is 980 MPa or more, an in-plane anisotropy δTS of the thin high-strength cold-rolled steel sheet in terms of tensile strength defined by Formula (1) below is 25 MPa or less:

$$\delta TS=(TS_L+TS_C-2\times TS_D)/2 \quad (1)$$

(where δTS: in-plane anisotropy (MPa) in terms of tensile strength TS, $TS_L$: tensile strength (MPa) in a direction parallel to the rolling direction (L direction), $TS_C$: tensile strength (MPa) in a direction (C direction) perpendicular to the rolling direction, and $TS_D$: tensile strength (MPa) in a direction (D direction) inclined at an angle of 45° with respect to the rolling direction), and an in-plane anisotropy δEl of the thin high-strength cold-rolled steel sheet in terms of total elongation defined by Formula (2) below is 10% or less:

$$\delta El=(El_L+El_C-2\times El_D)/2 \quad (2)$$

(where δEl: in-plane anisotropy (%) in terms of total elongation El, $El_L$: total elongation (%) in a direction parallel to the rolling direction (L direction), $El_C$: total elongation (%) in a direction (C direction) perpendicular to the rolling direction, and $El_D$: total elongation (%) in a direction (D direction) inclined at an angle of 45° with respect to the rolling direction).

(2) The thin high-strength cold-rolled steel sheet described in (1), wherein the composition further contains, by mass, one or more groups selected from Groups A to D below.

Group A: one or more elements selected from B: 0.0001% to 0.0050%, Cr: 0.05% to 1.00%, and Cu: 0.05% to 1.00%

Group B: one or two elements selected from Sb: 0.002% to 0.200% and Sn: 0.002% to 0.200%

Group C: Ta: 0.001% to 0.100%

Group D: one or more elements selected from Ca: 0.0005% to 0.0050%, Mg: 0.0005% to 0.0050%, and REM: 0.0005% to 0.0050%

(3) The thin high-strength cold-rolled steel sheet described in (1) or (2), provided with a plating layer of any one selected from a hot-dip galvanizing layer, a hot-dip galvannealing layer, and an electrogalvanizing layer, which is deposited on a surface of the thin high-strength cold-rolled steel sheet.

(4) A method of producing a thin high-strength cold-rolled steel sheet in which a steel is subjected to a hot-rolling step, a pickling step, a cold-rolling step, and annealing step in this order to form a thin cold-rolled steel sheet, wherein the steel has a composition containing, by mass, C: more than 0.20% and 0.45% or less, Si: 0.50% to 2.50%, Mn: 2.00% or more and less than 3.50%, P: 0.001% to 0.100%, S: 0.0200% or less, N: 0.0100% or less, Al: 0.01% to 0.100%, and one or two elements selected from Ti: 0.005% to 0.100% and Nb: 0.005% to 0.100%, the balance being Fe and inevitable impurities, the hot-rolling step includes heating the steel and forming the steel into a hot-rolled steel sheet having a predetermined thickness, the cold-rolling step includes cold-rolling the hot-rolled steel sheet at a rolling reduction of 30% or more to form the hot-rolled steel sheet into a thin cold-rolled steel sheet having a predetermined thickness, the annealing step includes first and second annealing treatments, the first annealing treatment including heating the thin cold-rolled steel sheet to an annealing temperature of 800° C. to 950° C. and subsequently cooling the thin cold-rolled steel sheet to a cooling-end temperature of 350° C. to 500° C. at a cooling rate such that the average cooling rate between the annealing temperature and the cooling-end temperature is 5° C./s or more to form the thin cold-rolled steel sheet into a thin cold-rolled and annealed steel sheet having a microstructure including a martensite phase and a bainite phase such that the total volume fraction of the martensite phase and the bainite phase is 80% or more, and the second annealing treatment including heating the thin cold-rolled and annealed steel sheet to an annealing temperature of 700° C. to 840° C., holding the thin cold-rolled and annealed steel sheet at 700° C. to 840° C. for 10 to 900 s, subsequently cooling the thin cold-rolled and annealed steel sheet to a cooling-end temperature range of 350° C. to 500° C. at a cooling rate such that the average cooling rate between the annealing temperature and the cooling-end temperature is 5 to 50° C./s, and holding the thin cold-rolled and annealed steel sheet within the cooling-end temperature range for 10 to 1800 s.

(5) The method of producing a thin high-strength cold-rolled steel sheet described in (4), wherein the composition further contains, by mass, one or more groups selected from Groups A to D below:

Group A: one or more elements selected from B: 0.0001% to 0.0050%, Cr: 0.05% to 1.00%, and Cu: 0.05% to 1.00%

Group B: one or two elements selected from Sb: 0.002% to 0.200% and Sn: 0.002% to 0.200%

Group C: Ta: 0.001% to 0.100% Group D: one or more elements selected from Ca: 0.0005% to 0.0050%, Mg: 0.0005% to 0.0050%, and REM: 0.0005% to 0.0050%.

(6) The method of producing a thin high-strength cold-rolled steel sheet described in (4) or (5), wherein, subsequent to the second annealing treatment included in the annealing step, any one of a hot-dip galvanizing treatment, a set of a hot-dip galvanizing treatment and an alloying treatment, and an electrogalvanizing treatment is performed.

It is thus possible to consistently produce a thin high-strength cold-rolled steel sheet having a high tensile strength of 980 MPa or more and high ductility in which the fluctuations in the strength and total elongation of the steel sheet with the temperature at which annealing is performed are small, that is, in which the in-plane anisotropies of the steel sheet in terms of strength and total elongation are small, in an advantageous manner from an industrial viewpoint. Furthermore, using the thin high-strength cold-rolled steel sheet as an automotive structural member may markedly reduce the weights of automotive bodies and, as a result, markedly improve the fuel economy of automobiles.

DETAILED DESCRIPTION

We studied various factors that may affect the strength, ductility, production consistency, and in-plane anisotropies of a steel sheet and, as a result, found that adding C: more than 0.20% by mass and Ti and/or Nb to a steel sheet enables the desired high strength of the steel sheet to be achieved, reduces fluctuations in the strength and elongation of the steel sheet even when the temperature at which the annealing treatment is performed widely varies (700° C. to 840° C.), and makes it possible to produce a thin high-strength steel sheet having excellent production consistency. We also found that the in-plane anisotropies of the thin high-strength steel sheet can be reduced when the steel sheet has, in addition to the above-described composition, a microstructure including an appropriate amount of acicular and fine retained austenite grains dispersed in the ferrite phase.

We further found that the thin high-strength steel sheet having the above-described microstructure can be produced by subjecting a thin cold-rolled steel sheet having the above-described composition prepared by performing cold-rolling at a rolling reduction of 30% or more to a two-stage annealing treatment consisting of an annealing treatment (first annealing treatment) in which the thin cold-rolled steel sheet is heated and then cooled and another annealing treatment (second annealing treatment) in which the thin cold-rolled steel sheet is heated to a dual-phase temperature range, held for a short period of time, subsequently cooled to a cooling-end temperature that falls within a predetermined temperature range, and held within the temperature range for a predetermined amount of time. Subjecting the cold-rolled steel sheet to the first annealing treatment enables the cold-rolled steel sheet to be formed into a thin cold-rolled and annealed steel sheet having a microstructure including the martensite phase and the bainite phase such that the total volume fraction of the martensite phase and the bainite phase is 80% or more. Moreover, subjecting the thin cold-rolled and annealed steel sheet to the second annealing treatment enables the thin cold-rolled and annealed steel sheet to be formed into a thin cold-rolled and annealed steel sheet (thin high-strength cold-rolled steel sheet) including an appropriate amount of highly stable, fine and acicular crystal grains of the retained austenite phase dispersed therein. As a result, a thin high-strength cold-rolled steel sheet having small in-plane anisotropies can be produced.

Our thin high-strength cold-rolled steel sheet therefore has a composition containing, by mass, C: more than 0.20% and 0.45% or less, Si: 0.50% to 2.50%, Mn: 2.00% or more and less than 3.50%, P: 0.001% to 0.100%, S: 0.0200% or less, N: 0.0100% or less, Al: 0.01% to 0.100%, and one or two elements selected from Ti: 0.005% to 0.100% and Nb: 0.005% to 0.100% with the balance including Fe and inevitable impurities.

The reasons for the limitations on the composition of the steel sheet are described below. In the following descriptions, "% by mass" is referred to simply as "%" unless otherwise stated.

C: More Than 0.20% and 0.45% or Less

Carbon (C) has a high solid-solution strengthening ability and improves the strength of the steel sheet. C also contributes to the stabilization of the retained austenite phase and enables the desired volume fraction of the retained austenite phase to be maintained. This effectively improves the ductility of the steel sheet. The C content needs to be more than 0.20% to achieve the above advantageous effects. It may become difficult to form the desired amount of retained austenite phase if the C content is 0.20% or less. On the other hand, if the C content is excessively large, that is, more than 0.45%, the toughness of the steel sheet and weldability may be deteriorated. In addition, delayed fracture may occur. Accordingly, the C content is limited to be more than 0.20% and 0.45% or less. The C content is preferably 0.25% or more and is more preferably 0.287% or more. The C content is preferably 0.40% or less and is more preferably 0.37% or less.

Si: 0.50% to 2.50%

Silicon (Si) has a high solid-solution strengthening ability in the ferrite phase and improves the strength of the steel sheet. Si also inhibits the formation of carbides (cementite) and contributes to the stabilization of the retained austenite phase. Thus, Si is a valuable element. Si also cleans the ferrite phase by causing C (solute) included in the ferrite phase to be emitted into the austenite phase. This improves the ductility of the steel sheet. Si dissolved in the ferrite phase improves work hardenability and ductility of the ferrite phase. The Si content needs to be 0.50% or more to achieve the above advantageous effects. However, if the Si content exceeds 2.50%, formation of the retained austenite phase may be inhibited. Accordingly, the Si content is limited to be 0.50% to 2.50%. The Si content is preferably 0.80% or more and is more preferably 1.00% or more. The Si content is preferably 2.00% or less and is more preferably 1.80% or less.

Mn: 2.00% or More and Less Than 3.50%

Manganese (Mn) causes solid-solution strengthening and improves hardenability and effectively improves the strength of the steel sheet. Mn is also an austenite-stabilizing element and an element essential to maintain the desired amount of retained austenite. The Mn content needs to be 2.00% or more to achieve the above advantageous effect. However, if the Mn content is excessively large, that is, 3.50% or more, it may become difficult to form the desired amount of retained austenite. Accordingly, the Mn content is limited to be 2.00% or more and less than 3.50%. The Mn content is preferably 2.30% or more and 3.00% or less.

P: 0.001% to 0.100%

Phosphor (P) is an element that improves the strength of the steel sheet by solid-solution strengthening and added to the steel sheet in an amount appropriate to the desired strength of the steel sheet. P is also an element that promotes ferrite transformation and is effective to form a composite microstructure. The P content needs to be 0.001% or more to achieve the above advantageous effects. However, if the P content exceeds 0.100%, weldability may be deteriorated. Furthermore, intergranular segregation, which increases the risk of intergranular fracture, may occur. Accordingly, the P content is limited to be 0.001% to 0.100%. The P content is preferably 0.005% or more and 0.050% or less.

S: 0.0200% or Less

Sulfur (S) is an element that segregates at grain boundaries and makes the steel brittle during hot working. S also forms a sulfide in the steel and deteriorates local deformability. Thus, the S content is desirably minimized. However, the above adverse impacts may be allowable when the S content is 0.0200% or less. Accordingly, the S content is limited to be 0.0200% or less. The S content is desirably 0.0001% or more, because reducing the S content to an excessively low level may limit the production technique and increase the steel-refining costs.

N: 0.0100% or Less

Nitrogen (N) is an element that deteriorates the aging resistance of the steel. Thus, the N content is desirably minimized. However, the above adverse impacts may be allowable when the N content is 0.0100% or less. Accordingly, the N content is limited to be 0.0100% or less. The N content is preferably 0.0070% or less. The N content is desirably 0.0005% or more, because reducing the N content to an excessively low level may limit the production technique and increase the steel-refining costs.

Al: 0.01% to 0.100%

Aluminum (Al) is a ferrite-forming element and an element that improves the balance (strength-ductility balance) between the strength and ductility of the steel sheet. The Al content needs to be 0.01% or more to achieve the above advantageous effects. However, if the Al content exceeds 0.100%, the properties of the surface of the steel sheet may be deteriorated. Accordingly, the Al content is limited to be 0.01% to 0.100%. The Al content is preferably 0.03% or more and is more preferably 0.055% or more. The Al content is preferably 0.08% or less and is more preferably 0.07% or less.

One or Two Elements Selected from Ti: 0.005% to 0.100% and Nb: 0.005% to 0.100%

Titanium (Ti) and Niobium (Nb) are valuable elements that inhibit an increase in the sizes of crystal grains occurring during heating in the annealing step or the like and make crystal grains constituting the microstructure of the annealed steel sheet fine and uniform in an effective manner. This reduces the fluctuations in the strength and total elongation of the steel sheet with the temperature at which the annealing step is conducted and improves production consistency. Accordingly, the steel sheet includes one or two elements selected from Ti and Nb. The Ti and Nb contents need to be Ti: 0.005% or more and Nb: 0.005% or more to achieve the above advantageous effects. However, if the Ti and Nb contents exceed Ti: 0.100% and Nb: 0.100%, excessively large amounts of Ti precipitate and Nb precipitate may be formed in the ferrite phase, which deteriorate the ductility (total elongation) of the steel sheet. Accordingly, the Ti content is limited to be 0.005% to 0.100%, and the Nb content is limited to be 0.005% to 0.100%. The Ti content is preferably 0.010% or more and 0.080% or less. The Nb content is preferably 0.010% or more and 0.080% or less.

The above-described constituents are the fundamental constituents. The steel sheet may further include, in addition to the fundamental constituents, an optional element that belongs to one or more groups selected from Groups A to D below.

Group A: One or More Elements Selected from B: 0.0001% to 0.0050%, Cr: 0.05% to 1.00%, and Cu: 0.05% to 1.00%

Group A: boron (B), chromium (Cr), and copper (Cu) are elements that improve the strength of the steel sheet. One or more elements selected from B, Cr, and Cu may be added to the steel sheet as needed.

Boron (B) is a valuable element that improves hardenability and, as a result, improves the strength of the steel sheet. The B content needs to be 0.0001% or more to achieve the above advantageous effects. However, if the B content exceeds 0.0050%, the content of the martensite phase may be excessively increased. This excessively increases the strength of the steel sheet and deteriorates the ductility of the steel sheet. Accordingly, when the steel sheet includes B, the B content is preferably limited to be 0.0001% to 0.0050%. The B content is more preferably 0.0005% or more and 0.0030% or less.

Chromium (Cr) improves the strength of the steel sheet by solid-solution strengthening. Cr also stabilizes the austenite phase when cooling is performed in the annealing step. This facilitates formation of the composite microstructure. The Cr content needs to be 0.05% or more to achieve the above advantageous effects. However, if the Cr content is excessively large, that is, more than 1.00%, the formability of the steel sheet may be deteriorated. Accordingly, when the steel sheet includes Cr, the Cr content is preferably limited to be 0.05% to 1.00%.

Copper (Cu) improves the strength of the steel sheet by solid-solution strengthening. Cu also stabilizes the austenite phase when cooling is performed in the annealing step. This facilitates the formation of the composite microstructure. The Cu content needs to be 0.05% or more to achieve the above advantageous effects. However, if the Cu content is excessively large, that is, more than 1.00%, the formability of the steel sheet may be deteriorated. Accordingly, when the steel sheet includes Cu, the Cu content is preferably limited to be 0.05% to 1.00%.

Group B: One or Two Elements Selected from Sb: 0.002% to 0.200% and Sn: 0.002% to 0.200%

Group B: antimony (Sb) and tin (Sn) are elements that reduce decarburization of the surface layer of the steel sheet. One or two elements selected from Sb and Sn may be added to the steel sheet as needed.

Antimony (Sb) and tin (Sn) reduce decarburization of the surface layer (region extending several tens of micrometers) of the steel sheet occurring as a result of the nitridation or oxidation of the surface layer of the steel sheet. Thus, reducing the nitridation and oxidation of the surface layer of the steel sheet may limit a reduction in the amount of martensite phase formed in the surface of the steel sheet. This enables the desired strength of the steel sheet to be achieved and reduces the fluctuations in strength and elongation with the temperature at which annealing is performed. As a result, production consistency may be achieved in an effective manner. The Sb and Sn contents need to be 0.002% or more to achieve the above advantageous effects. However, if the Sb and Sn contents are excessively large, that is, more than 0.200%, the toughness of the steel sheet may be deteriorated. Accordingly, when the steel sheet includes Sb and Sn, the Sb and Sn contents are preferably each limited to be 0.002% to 0.200%.

Group C: Ta: 0.001% to 0.100%

Group C: tantalum (Ta) forms carbide or a carbonitride and improves the strength of the steel sheet. The Ta content needs to be 0.001% or more to achieve the above advantageous effects. However, if the Ta content is excessively large, that is, more than 0.100%, the material costs are increased, but the advantageous effects do not increase in a manner appropriate to the Ta content. This is economically disadvantageous. Accordingly, when the steel sheet includes Ta, the Ta content is preferably limited to be 0.001% to 0.100%.

Group D: One or More Elements Selected from Ca: 0.0005% to 0.0050%, Mg: 0.0005% to 0.0050%, and REM: 0.0005% to 0.0050%

Group D: Since calcium (Ca), magnesium (Mg), and rare-earth metals (REMs) are elements that enable spherical sulfide particles to be formed and reduce the adverse impacts of the sulfide to local ductility and stretch-flange formability, one or more elements selected from Ca, Mg, and REMs may be added to the steel sheet as needed. The Ca, Mg, and REM contents each need to be 0.0005% or more to achieve the above advantageous effects. However, if the Ca, Mg, or REM content is excessively large, that is, more than 0.0050%, the amount of inclusions and the like may be increased, which cause surface defects and internal defects to occur. Accordingly, when the steel sheet includes Ca, Mg, and REM, the Ca, Mg, and REM contents are preferably each limited to be 0.0005% to 0.0050%.

The balance of the composition which is other than the above-described constituents includes Fe and inevitable impurities.

The reasons for the limitations on the microstructure of the thin high-strength cold-rolled steel sheet are described below.

The thin high-strength cold-rolled steel sheet has a composite microstructure including the ferrite phase serving as a parent phase and crystal grains of the retained austenite phase dispersed in the parent phase. Specifically, the composite microstructure is a microstructure including, by volume, 15% or more and 70% or less ferrite phase and more than 15% and 40% or less retained austenite phase with the balance being 30% or less (not including 0%) martensite phase or including 30% or less (not including 0%) martensite phase and 10% or less (including 0%) pearlite phase and/or carbide at a position (¼-thickness position) corresponding to ¼ of the thickness of the steel sheet from the surface in the thickness direction.

Ferrite Phase: 15% or More and 70% or Less by Volume

Since the ferrite phase improves the ductility (elongation) of the steel sheet, the microstructure of the steel sheet includes 15% or more ferrite phase by volume. If the volume fraction of the ferrite phase is less than 15%, it may become difficult to achieve the desired ductility of the steel sheet. However, if the volume fraction of the ferrite phase exceeds 70%, the desired high strength of the steel sheet may fail to be achieved. Accordingly, the volume fraction of the ferrite phase is limited to be 15% or more and 70% or less. The volume fraction of the ferrite phase is preferably 20% to 65%. The term "ferrite phase" used herein also refers to polygonal ferrite phase, acicular ferrite phase, and bainitic ferrite phase.

Retained Austenite Phase: More than 15% and 40% or Less by Volume

The retained austenite phase is a phase itself having high ductility, and is a microstructure that undergoes strain-induced transformation and improves the ductility of the steel sheet. The retained austenite phase improves the ductility of the steel sheet and the balance between the strength and ductility of the steel sheet. The volume fraction of the retained austenite phase needs to be more than 15% to achieve the above advantageous effects. However, if the volume fraction of the retained austenite phase is more than 40%, the strength of the steel sheet may be reduced. As a result, the desired high strength of the steel sheet may fail to be achieved. Accordingly, the volume fraction of the retained austenite phase is limited to be more than 15% and 40% or less. The volume fraction of the retained austenite phase is preferably 20% or more.

The retained austenite phase is constituted of acicular and fine crystal grains having an average diameter of 2.0 μm or less and an aspect ratio of 2.0 or more. When the retained austenite phase is constituted of such acicular and fine crystal grains, ease of migration (diffusion) of C and alloying elements may be increased and, as a result, the stability of the retained austenite phase may be enhanced. This markedly improves the ductility (elongation) of the steel sheet and reduces the in-plane anisotropies of the steel sheet in terms of strength and elongation.

Average Crystal Grain Diameter of Retained Austenite Phase: 2.0 μm or Less

If the average crystal grain diameter of the retained austenite phase is larger than 2.0 μm, stability to strain may be deteriorated and, as a result, the desired high ductility (total elongation) of the steel sheet may fail to be achieved. Accordingly, the average crystal grain diameter of the retained austenite phase is limited to be 2.0 μm or less. The average crystal grain diameter of the retained austenite phase is preferably 1.5 μm or less. The average crystal grain diameter of the retained austenite phase is more preferably 0.5 μm or less to achieve the desired high strength of the steel sheet.

Aspect Ratio of Retained Austenite Phase: 2.0 or More

When the retained austenite phase is constituted of the above-described fine crystal grains and the fine crystal grains have an acicular shape having an aspect ratio of 2.0 or more, the ductility (elongation) of the steel sheet may be markedly improved and the in-plane anisotropies of the steel sheet in terms of strength and elongation may be further reduced. Accordingly, the aspect ratio of the retained austenite phase is limited to be 2.0 or more. The aspect ratio of the retained austenite phase is preferably 2.5 or more. However, if the aspect ratio of the retained austenite phase is more than 5.0, the in-plane anisotropies of the steel sheet in terms of strength and elongation are not reduced but increased. Thus, the aspect ratio of the retained austenite phase is preferably 5.0 or less. The term "aspect ratio" used herein refers to the ratio between the longer and shorter axes of retained austenite crystal grains (ratio of the longer axis to the shorter axis).

In the high-strength cold-rolled steel sheet, the balance of the microstructure other than the ferrite phase and the retained austenite phase described above includes the martensite phase having the volume fraction of 30% or less (not including 0%) to the entire microstructure. The term "martensite phase" used herein also refers to the fresh martensite phase and the tempered martensite phase.

If the volume fraction of the martensite phase is more than 30%, the ductility of the steel sheet may be deteriorated. As a result, the desired high ductility of the steel sheet may fail to be achieved. The volume fraction of the martensite phase is not 0% and is desirably 3% or more to achieve the desired high strength of the steel sheet.

The balance of the microstructure which is other than the ferrite phase and the retained austenite phase may further include, in addition to the above-described martensite phase, the pearlite phase and/or a carbide such that the volume fraction of the pearlite phase and/or the carbide to the entire microstructure is 10% or less (including 0%). The carbide may be cementite, Ti-based carbide, or Nb-based carbide.

The above-described microstructure may be formed by controlling production conditions and, in particular, the first and second annealing substeps. The microstructure can be determined by the method described in the Examples below.

The thin high-strength cold-rolled steel sheet having the above-described composition and the above-described microstructure may be provided with a plating layer disposed on the surface to enhance the corrosion resistance of the steel sheet. The plating layer is preferably any one of a hot-dip galvanizing layer, a hot-dip galvannealing layer, and an electrogalvanizing layer. Commonly known hot-dip galvanizing layers, hot-dip galvannealing layers, and electrogalvanizing layers may be suitably used as a hot-dip galvanizing layer, a hot-dip galvannealing layer, and an electrogalvanizing layer, respectively.

A preferable method of producing the thin high-strength cold-rolled steel sheet is described.

A steel having the above-described composition is subjected to a hot-rolling step, a pickling step, a cold-rolling step, and an annealing step in this order to form a thin high-strength cold-rolled steel sheet.

The method of producing the steel is not limited. The steel is preferably produced by preparing a molten steel having the above composition by a common method using a converter or the like and forming the molten steel into a cast slab (steel) such as a slab having predetermined dimensions by a common continuous casting method. Ingot-making and blooming may be employed to prepare the steel slab (steel).

The steel having the above composition is subjected to a hot-rolling step to form a hot-rolled steel sheet.

The hot-rolling step is not limited. Any hot-rolling step in which the steel having the above composition is heated and hot-rolled to form a hot-rolled steel sheet having predetermined dimensions may be conducted. Any common hot-rolling method may be employed. An example of the hot-rolling method is a method in which the steel is heated at a heating temperature of 1100° C. to 1250° C. and hot-rolled with a hot-rolling delivery temperature of 850° C. to 950° C.; after hot rolling has been finished, the resulting hot-rolled steel sheet is subjected to adequate post-roll cooling in which, specifically, the hot-rolled steel sheet is cooled at a cooling rate such that the average cooling rate between 450° C. and 950° C. is 40 to 100° C./s; and the cooled hot-rolled steel sheet is coiled at a coiling temperature of 450° C. to 650° C. to form a hot-rolled steel sheet having predetermined dimensions.

The hot-rolled steel sheet is subjected to a pickling step. The pickling step is not limited. Any pickling step in which the hot-rolled steel sheet is pickled to a degree at which the hot-rolled steel sheet can be cold-rolled may be conducted. Any common pickling method in which hydrochloric acid, sulfuric acid or the like is used may be employed.

The hot-rolled steel sheet that has been subjected to the pickling step is subjected to a cold-rolling step.

In the cold-rolling step, the hot-rolled steel sheet subjected to the pickling step is cold-rolled at a rolling reduction of 30% or more to form a thin cold-rolled steel sheet having a predetermined thickness.

Rolling Reduction in Cold Rolling: 30% or More

The rolling reduction in cold rolling is 30% or more. The amount of processing may be insufficient if the rolling reduction is less than 30%. In such a case, in the following annealing step, recrystallization of the processed ferrite may fail to be sufficiently achieved. This makes it difficult to achieve the desired high ductility of the steel sheet and the good strength-ductility balance. Accordingly, the rolling reduction in cold rolling is limited to be 30% or more. However, while the upper limit of the rolling reduction is determined in accordance with the capacity of the cold-rolling machine used, if the rolling reduction is high, that is, more than 70%, the rolling load may be excessively increased and, as a result, productivity may be deteriorated. Therefore, the upper limit of the rolling reduction is preferably set to about 70%. It is not necessary to limit the number of rolling paths and the rolling reduction per path.

The thin cold-rolled steel sheet is subsequently subjected to an annealing step.

The annealing step is constituted of first and second annealing substeps.

In the first annealing substep, the thin cold-rolled steel sheet is heated to an annealing temperature of 800° C. to 950° C. and subsequently cooled to a cooling-end temperature of 350° C. to 500° C. at a cooling rate such that the average cooling rate between the annealing temperature and the cooling-end temperature is 5° C./s or more to form a thin cold-rolled and annealed steel sheet having a microstructure including the martensite phase and the bainite phase such that the total volume fraction of the martensite phase and the bainite phase is 80% or more.

Annealing Temperature T1: 800° C. to 950° C.

If the annealing temperature is less than 800° C., an excessively large amount of ferrite phase may be formed during annealing and the desired total amount of martensite phase and bainite phase may fail to be achieved. As a result, the desired amount of retained austenite phase may fail to be formed in the thin cold-rolled and annealed steel sheet produced in the second annealing substep. This makes it difficult to achieve the desired high strength and high ductility of the steel sheet. On the other hand, if the annealing temperature exceeds 950° C., excessively large austenite grains may be formed that inhibit formation of ferrite in the second annealing sub step. As a result, the desired amount of fine retained austenite phase may fail to be formed in the thin cold-rolled and annealed steel sheet produced in the second annealing substep. This makes it difficult to achieve the desired high ductility of the steel sheet and deteriorates the strength-ductility balance. Accordingly, in the first annealing substep, the annealing temperature T1 is limited to 800° C. to 950° C.

Average Cooling Rate: 5° C./s or More

If the average cooling rate between the annealing temperature and the cooling-end temperature is less than 5° C./s, the ferrite phase and the pearlite phase may be formed during cooling. This makes it difficult to form the predetermined amount of martensite phase and bainite phase. Accordingly, the average cooling rate at which the temperature is reduced from the annealing temperature is limited to be 5° C./s or more. Although it is not necessary to set the upper limit of the cooling rate, the cooling rate is preferably 50° C./s or less. Achieving a cooling rate exceeding 50° C./s requires an excessively large cooling apparatus. Thus, the upper limit of the cooling rate is preferably set such that the average cooling rate is 50° C./s or less in consideration of production technology, capital investment and the like. To perform cooling, gas cooling is preferably employed. Gas cooling may be performed in combination with furnace cooling, mist cooling or the like.

Cooling-End Temperature T2: 350° C. to 500° C.

The cooling-end temperature is 350° C. to 500° C. to form, after cooling has been performed, a microstructure including the martensite phase and the bainite phase such that the total volume fraction of the martensite phase and the bainite phase is 80% or more. If the cooling-end temperature exceeds 500° C., the above-described microstructure may fail to be formed after cooling has been performed. On the other hand, if the cooling-end temperature is less than 350° C., it may become difficult to form a thin cold-rolled and annealed steel sheet having a microstructure in which the average crystal grain diameter of the retained austenite phase is 2 μm or less and the aspect ratio of the retained austenite phase is 2.0 or more after the second annealing substep has been conducted. This makes it difficult to achieve the desired high ductility of the steel sheet and deteriorate the strength-ductility balance.

After cooling has been ended, the second annealing substep may be conducted immediately. Alternatively, after cooling has been ended, air cooling may be performed to room temperature prior to the second annealing substep.

Total of Martensite Phase and Bainite Phase: 80% or More by Volume

If the total volume fraction of the martensite phase and the bainite phase in the microstructure of the steel sheet that has been subjected to the first annealing substep is less than 80%, it may become difficult to form a thin cold-rolled and annealed steel sheet including the desired fine and acicular retained austenite phase in the second annealing substep. As a result, the desired high ductility and good strength-ductility balance may fail to be achieved. Furthermore, it may become difficult to achieve excellent production consistency.

In the second annealing substep, the above-described thin cold-rolled and annealed steel sheet is held at an annealing temperature of 700° C. to 840° C. for 10 to 900 s, subsequently cooled to a cooling-end temperature of 350° C. to 500° C. at a cooling rate such that the average cooling rate between the annealing temperature and the cooling-end temperature is 5 to 50° C./s, held in the cooling-end temperature for 10 to 1800 s, and then allowed to cool.

Annealing Temperature T3 in Second Annealing Substep: 700° C. to 840° C.

If the annealing temperature in the second annealing substep is less than 700° C., a sufficient amount of austenite phase may fail to be formed in annealing. This may result in failure to form the desired amount of retained austenite phase and achieve the desired high ductility of the steel sheet and good strength-ductility balance. On the other hand, if the annealing temperature exceeds 840° C., the temperature falls in the austenite-single-phase region. This results in failure to form a desired amount of fine and acicular retained austenite phase and makes it difficult to achieve the desired high ductility of the steel sheet and good strength-ductility balance. Accordingly, the annealing temperature in the second annealing substep is limited to 700° C. to 840° C. The annealing temperature in the second annealing substep is preferably 720° C. to 820° C.

Holding Time at Annealing Temperature: 10 to 900 s

If the amount of time during which holding is performed at the annealing temperature is less than 10 s, a sufficient amount of austenite phase may fail to be formed in annealing. This may result in failure to form the desired amount of retained austenite phase and achieve the desired high ductility of the steel sheet and good strength-ductility balance. On the other hand, if the holding time is long, that is, more than 900 s, excessively large crystal grains may be formed and, as a result, the desired amount of fine and acicular retained austenite phase may fail to be formed. This may result in failure to achieve the desired high ductility of the steel sheet and good strength-ductility balance. In addition, productivity may be deteriorated. Accordingly, the amount of time during which holding is performed at the annealing temperature in the second annealing substep is limited to 10 to 900 s.

Average Cooling Rate: 5 to 50° C./s

If the average cooling rate between the annealing temperature and the cooling-end temperature is less than 5° C./s, a large amount of ferrite phase may be formed during cooling. This makes it difficult to achieve the desired high strength of the steel sheet. On the other hand, if the average cooling rate exceeds 50° C./s, that is, rapid cooling is performed, excessively large amounts of low-temperature transformation phases such as the martensite phase and the bainite phase, may be formed. This results in failure to achieve the desired high ductility of the steel sheet and good strength-ductility balance. Accordingly, the average cooling rate at which the temperature is reduced from the annealing temperature in the second annealing substep is limited to 5 to 50° C./s. To perform cooling, gas cooling is preferably employed. Gas cooling may be performed in combination with furnace cooling, mist cooling, or the like.

Cooling-End Temperature T4: Temperature Falling within Cooling-End Temperature Range of 350° C. to 500° C.

If the cooling-end temperature is less than 350° C., a large amount of martensite phase may be formed while holding is performed after cooling has been stopped. This results in failure to form the desired microstructure. As a result, the desired high ductility of the steel sheet and good strength-ductility balance may fail to be achieved. On the other hand, if the cooling-end temperature exceeds 500° C., large amounts of ferrite phase and pearlite phase may be formed while holding is performed after cooling has been stopped. This results in failure to form the desired microstructure. As a result, the desired high ductility of the steel sheet and good strength-ductility balance may fail to be achieved. Accordingly, the cooling-end temperature in the second annealing sub step is limited to a temperature that falls within a cooling-end temperature range of 350° C. to 500° C.

Holding within Cooling-End Temperature Range: 10 to 1800 s

If the amount of time during which holding is performed within the cooling-end temperature range is less than 10 s, a sufficient amount of time may fail to be taken for the concentration of C in the austenite phase. This results in failure to form the desired amount of retained austenite phase. On the other hand, even if holding is performed for a long period of time exceeding 1800 s, the amount of retained austenite does not increase sufficiently. In addition, part of the retained austenite may be decomposed into the ferrite phase and cementite. Accordingly, the amount of time during which holding is performed within the cooling-end temperature range is limited to 10 to 1800 s. The term "holding" used herein also refers to, in addition to isothermal holding, slowly cooling or heating within the above temperature range.

It is not necessary to limit cooling performed after holding has been performed within the cooling-end temperature range. The temperature may be reduced to a desired temperature such as room temperature by any method such as air cooling.

Subsequent to the second annealing substep included in the annealing step, a plating treatment may be optionally performed to form a plating layer on the surface of the steel sheet. The plating treatment is preferably a hot-dip galvanizing treatment, a set of a hot-dip galvanizing treatment and an alloying treatment, or an electrogalvanizing treatment. Commonly known hot-dip galvanizing treatments, hot-dip galvanizing and alloying treatments, and electrogalvanizing treatments may be suitably used as a hot-dip galvanizing treatment, a hot-dip galvanizing and alloying treatment, and an electrogalvanizing treatment, respectively. Prior to the plating treatment, a pretreatment such as a degreasing treatment or a phosphate treatment is performed.

For example, the hot-dip galvanizing treatment is preferably a treatment performed using a common continuous hot-dip galvanizing line in which the thin cold-rolled and annealed steel sheet subjected to the above-described second annealing substep is dipped into a hot-dip galvanizing bath to form a predetermined amount of hot-dip galvanizing layer on the surface of the steel sheet. When the thin cold-rolled and annealed steel sheet is dipped into the plating bath, the temperature of the steel sheet is preferably adjusted to be within the range of (temperature of hot-dip galvanizing bath−50° C.) to (temperature of hot-dip galvanizing bath+80° C.) by reheating or cooling. The temperature of the hot-dip galvanizing bath is preferably 440° C. or more and 500° C. or less. The hot-dip galvanizing bath may contain, in addition to pure zinc, Al, Fe, Mg, Si, and/or the like. The amount of hot-dip galvanizing layer deposited on the surface of the steel sheet is preferably adjusted to a desired amount by controlling gas wiping or the like. It is preferable to set the amount of hot-dip galvanizing layer deposited to about 45 g/m$^2$ per side.

The plating layer (hot-dip galvanizing layer) formed by the above-described hot-dip galvanizing treatment may optionally be subjected to a common alloying treatment to form a hot-dip galvannealing layer. The alloying treatment is preferably performed at 460° C. or more and 600° C. or less. When a hot-dip galvanizing and alloying layer is formed, it is preferable to adjust the effective Al concentration in the plating bath to 0.10% to 0.22% by mass to form a plating layer having desired appearance.

The electrogalvanizing treatment is preferably a treatment in which a predetermined amount of electrogalvanizing layer is formed on the surface of the steel sheet with a common electrogalvanizing line. The amount of plating layer deposited is adjusted to the predetermined amount by controlling a sheet-feeding speed, a current and the like. The amount of plating layer deposited is preferably about 30 g/m$^2$ per side.

Our steel sheets and methods are further described with reference to the Examples below.

EXAMPLES

Molten steels having the compositions shown in Table 1 were each prepared using a converter and formed into a slab (a steel, thickness: 230 mm) by continuous casting. The resulting steels were each subjected to a hot-rolling step under the corresponding one of the sets of conditions shown in Table 2. Thereby, hot-rolled steel sheets having the thicknesses shown in Table 2 were prepared. The hot-rolled steel sheets were each subjected to a pickling step and subsequently to a cold-rolling step at the corresponding one of the rolling reductions shown in Tables 3 to 7. Thereby, thin cold-rolled steel sheets (thickness: 1.4 mm) were prepared. Hydrochloric acid was used to perform pickling.

The thin cold-rolled steel sheets were each subjected to an annealing step under the corresponding one of the sets of conditions shown in Tables 3 to 7 to form a thin cold-rolled and annealed steel sheet (thin cold-rolled steel sheet). The annealing step was constituted of two substeps, that is, first and second annealing substeps. After the first annealing substep had been finished, a test specimen for microstructure inspection was taken from each of the steel sheets. The test specimens were inspected for the microstructure of the steel sheet.

After the annealing step had been finished, some of the thin cold-rolled steel sheets were further each subjected to a hot-dip galvanizing treatment to form a hot-dip galvanizing layer on the surface and formed into a thin hot-dip galvanized steel sheet (GI). In the hot-dip galvanizing treatment, the thin cold-rolled and annealed steel sheets subjected to the annealing step were each reheated to 430° C. to 480° C. as needed and subsequently dipped into a hot-dip galvanizing bath (bath temperature: 470° C.) such that the amount of plating layer deposited was 45 g/m$^2$ per side in a continuous hot-dip galvanizing line. The composition of the bath was Zn-0.18 mass % Al. Some of the hot-dip galvanized steel sheets were each prepared using a bath having a composition of Zn-0.14 mass % Al and, after plating had been performed, subjected to an alloying treatment at 520° C. to form a thin hot-dip galvannealed steel sheet (GA). The Fe concentration in the plating layer was 9% or more and 12% or less by mass.

After the annealing step had been finished, some of the thin cold-rolled steel sheets were each subjected to an electrogalvanizing treatment using an electrogalvanizing line such that the amount of plating layer deposited was 30 g/m$^2$ per side to form a thin electrogalvanized steel sheet (EG).

TABLE 1

| Steel No. | Chemical composition (mass %) C | Si | Mn | P | S | Al | N | Ti, Nb | B, Cr, Cu | Ta | Sn, Sb | Ca, Mg, REM | Remark |
|---|---|---|---|---|---|---|---|---|---|---|---|---|---|
| A | 0.23 | 1.20 | 2.35 | 0.007 | 0.0015 | 0.05 | 0.0029 | Ti: 0.031 | — | — | — | — | Conforming Example |
| B | 0.26 | 1.67 | 2.60 | 0.012 | 0.0020 | 0.07 | 0.0044 | Nb: 0.042 | — | — | — | — | Conforming Example |
| C | 0.24 | 1.52 | 2.20 | 0.009 | 0.0010 | 0.03 | 0.0032 | Ti: 0.025, Nb: 0.013 | — | — | — | — | Conforming Example |
| D | 0.28 | 1.66 | 2.50 | 0.018 | 0.0011 | 0.07 | 0.0040 | Ti: 0.037 | — | — | — | — | Conforming Example |
| E | 0.30 | 1.23 | 2.60 | 0.011 | 0.0023 | 0.06 | 0.0053 | Nb: 0.042 | — | — | — | — | Conforming Example |
| F | 0.35 | 1.30 | 2.35 | 0.008 | 0.0010 | 0.06 | 0.0047 | Ti: 0.040 | — | — | — | — | Conforming Example |
| G | 0.40 | 1.58 | 2.50 | 0.021 | 0.0019 | 0.05 | 0.0037 | Nb: 0.038 | — | — | — | — | Conforming Example |
| H | 0.29 | 1.22 | 2.60 | 0.009 | 0.0021 | 0.04 | 0.0042 | Ti: 0.031 | — | — | — | — | Conforming Example |
| I | 0.30 | 1.72 | 2.35 | 0.023 | 0.0013 | 0.08 | 0.0051 | Ti: 0.052 | B: 0.0002 | — | — | — | Conforming Example |
| J | 0.27 | 1.39 | 2.95 | 0.012 | 0.0011 | 0.04 | 0.0045 | Nb: 0.041 | Cr: 0.13 | — | — | — | Conforming Example |
| K | 0.34 | 1.54 | 2.15 | 0.029 | 0.0020 | 0.03 | 0.0032 | Nb: 0.039 | Cu: 0.11 | — | — | — | Conforming Example |
| L | 0.32 | 1.43 | 3.05 | 0.012 | 0.0015 | 0.03 | 0.0040 | Nb: 0.029 | — | — | Sb: 0.05 | — | Conforming Example |
| M | 0.29 | 1.67 | 2.25 | 0.009 | 0.0020 | 0.05 | 0.0044 | Nb: 0.042 | — | — | Sn: 0.08 | — | Conforming Example |
| N | 0.28 | 1.59 | 2.50 | 0.002 | 0.0012 | 0.02 | 0.0050 | Nb: 0.030 | — | Ta: 0.04 | — | — | Conforming Example |
| O | 0.31 | 1.64 | 2.30 | 0.001 | 0.0008 | 0.07 | 0.0038 | Ti: 0.038 | — | — | — | Ca: 0.0024 | Conforming Example |
| P | 0.28 | 1.30 | 3.00 | 0.002 | 0.0010 | 0.03 | 0.0036 | Ti: 0.024 | — | — | — | Mg: 0.0013 | Conforming Example |
| Q | 0.30 | 1.70 | 2.20 | 0.003 | 0.0017 | 0.02 | 0.0029 | Ti: 0.052 | — | — | — | REM: 0.0021 | Conforming Example |
| R | 0.16 | 1.21 | 2.80 | 0.003 | 0.0012 | 0.04 | 0.0042 | Ti: 0.009 | — | — | — | — | Comparative Example |
| S | 0.48 | 1.23 | 2.25 | 0.002 | 0.0008 | 0.08 | 0.0032 | Ti: 0.015, Nb: 0.021 | — | — | — | — | Comparative Example |
| T | 0.28 | 0.25 | 2.35 | 0.003 | 0.0012 | 0.03 | 0.0036 | Ti: 0.028 | — | — | — | — | Comparative Example |
| U | 0.34 | 2.85 | 2.20 | 0.028 | 0.0009 | 0.09 | 0.0035 | Nb: 0.060 | — | — | — | — | Comparative Example |
| V | 0.31 | 1.27 | 1.67 | 0.012 | 0.0023 | 0.04 | 0.0042 | Nb: 0.033 | — | — | — | — | Comparative Example |
| W | 0.27 | 1.50 | 3.91 | 0.017 | 0.0015 | 0.02 | 0.0051 | Ti: 0.035 | — | — | — | — | Comparative Example |
| X | 0.32 | 1.60 | 2.60 | 0.012 | 0.0013 | 0.06 | 0.0044 | Ti:0.002 | — | — | — | — | Comparative Example |
| Y | 0.28 | 1.46 | 2.35 | 0.018 | 0.0020 | 0.05 | 0.0053 | Ti:0.16 | — | — | — | — | Comparative Example |
| Z | 0.24 | 1.73 | 2.10 | 0.023 | 0.0012 | 0.05 | 0.0029 | Nb:0.003 | — | — | — | — | Comparative Example |
| AA | 0.31 | 1.30 | 2.95 | 0.009 | 0.0010 | 0.04 | 0.0038 | Nb:0.14 | — | — | — | — | Comparative Example |
| AB | 0.36 | 1.45 | 2.55 | 0.008 | 0.0011 | 0.03 | 0.0040 | Ti: 0.002, Nb:0.003 | — | — | — | — | Comparative Example |

TABLE 2

| Hot-rolled sheet No. | Steel No. | Hot-rolling conditions Heating temperature (° C.) | Finish-rolling delivery temperature (° C.) | Cooling rate (° C./s) | Cooling end temperature (° C.) | Coiling temperature (° C.) | Thickness (mm) |
|---|---|---|---|---|---|---|---|
| HA1 | A | 1120 | 820 | 60 | 680 | 620 | 1.65 (for cold-rolling reduction of: 15%) |
| HA2 | A | 1200 | 900 | 60 | 630 | 570 | 2.15 (for cold-rolling reduction of: 35%) |
| HA3 | A | 1100 | 920 | 80 | 660 | 590 | 2.33 (for cold-rolling reduction of: 40%) |
| HA4 | A | 1190 | 880 | 50 | 510 | 480 | 2.55 (for cold-rolling reduction of: 45%) |
| HA5 | A | 1170 | 860 | 90 | 570 | 530 | 2.80 (for cold-rolling reduction of: 50%) |
| HA6 | A | 1140 | 890 | 40 | 540 | 500 | 3.11 (for cold-rolling reduction of: 55%) |
| HA7 | A | 1150 | 850 | 50 | 650 | 610 | 3.50 (for cold-rolling reduction of: 60%) |
| HA8 | A | 1230 | 870 | 70 | 690 | 640 | 4.00 (for cold-rolling reduction of: 65%) |
| HA9 | A | 1210 | 910 | 70 | 570 | 540 | 4.67 (for cold-rolling reduction of: 70%) |
| HA0 | A | 1200 | 940 | 70 | 600 | 550 | 5.60 (for cold-rolling reduction of: 75%) |
| HB | B | 1200 | 920 | 80 | 540 | 510 | 2.55 |
| HC | C | 1140 | 930 | 60 | 640 | 580 | 3.11 |
| HD | D | 1240 | 900 | 90 | 700 | 640 | 2.15 |
| HE | E | 1180 | 860 | 50 | 680 | 630 | 2.33 |
| HF | F | 1170 | 880 | 50 | 670 | 630 | 7.00 |
| HG | G | 1130 | 870 | 100 | 520 | 480 | 2.15 |
| HH | H | 1150 | 870 | 80 | 560 | 500 | 4.67 |
| HI | I | 1110 | 890 | 70 | 560 | 510 | 2.55 |
| HJ | J | 1120 | 860 | 80 | 500 | 460 | 3.50 |
| HK | K | 1210 | 910 | 60 | 620 | 560 | 1.86 |
| HL | L | 1190 | 940 | 70 | 590 | 520 | 4.00 |

TABLE 2-continued

| Hot-rolled sheet No. | Steel No. | Hot-rolling conditions: Heating temperature (° C.) | Finish-rolling delivery temperature (° C.) | Cooling rate (° C./s) | Cooling end temperature (° C.) | Coiling temperature (° C.) | Thickness (mm) |
|---|---|---|---|---|---|---|---|
| HM | M | 1230 | 930 | 50 | 660 | 600 | 2.33 |
| HN | N | 1230 | 900 | 90 | 660 | 610 | 14.0 |
| HO | O | 1160 | 910 | 90 | 640 | 600 | 2.55 |
| HP | P | 1200 | 890 | 80 | 600 | 570 | 3.50 |
| HQ | Q | 1200 | 880 | 50 | 510 | 480 | 3.11 |
| HR | R | 1130 | 920 | 70 | 590 | 530 | 2.33 |
| HS | S | 1140 | 860 | 70 | 580 | 540 | 2.15 |
| HT | T | 1180 | 870 | 70 | 580 | 540 | 4.67 |
| HU | U | 1150 | 900 | 80 | 640 | 580 | 3.50 |
| HV | V | 1120 | 900 | 90 | 630 | 600 | 4.00 |
| HW | W | 1220 | 930 | 50 | 690 | 630 | 5.60 |
| HX | X | 1210 | 870 | 50 | 570 | 510 | 4.00 |
| HY | Y | 1190 | 910 | 40 | 650 | 600 | 5.60 |
| HZ | Z | 1190 | 910 | 60 | 500 | 470 | 4.00 |
| HAA | AA | 1150 | 850 | 60 | 590 | 550 | 2.55 |
| HAB | AB | 1130 | 850 | 60 | 670 | 610 | 4.00 |

TABLE 3

| | | | | Annealing step: First annealing substep | | | | | Second annealing substep | | | | | | | | |
|---|---|---|---|---|---|---|---|---|---|---|---|---|---|---|---|---|---|
| Cold-rolled sheet No. | Hot-rolled sheet No. | Steel No. | Cold rolling Rolling reduction (%) | Annealing temperature T1 (° C.) | Average cooling rate (° C./s) | Cooling end temperature T2 (° C.) | Cooling means | M + B** fraction (volume %) | Annealing temperature T3 (° C.) | Annealing holding time (s) | Average cooling rate (° C./s) | Cooling end temperature T4 (° C.) | Cooling means | Holding temperature range (° C.) | Holding time (s) | Plating Type* | Remark |
| 1 | HA5 | A | 50 | 810 | 10 | 430 | Gas + furnace cooling | 90 | 790 | 60 | 35 | 390 | Gas | 370 | 500 | GI | Example |
| 2 | HA5 | A | 50 | 860 | 10 | 430 | Gas + furnace cooling | 90 | 790 | 60 | 35 | 390 | Gas | 370 | 500 | GI | Example |
| 3 | HA5 | A | 50 | 910 | 10 | 430 | Gas + furnace cooling | 90 | 790 | 60 | 35 | 390 | Gas | 370 | 500 | GI | Example |
| 4 | HB | B | 45 | 940 | 20 | 360 | Gas + mist | 83 | 830 | 600 | 25 | 380 | Gas | 360 | 400 | — | Example |
| 5 | HB | B | 45 | 940 | 20 | 400 | Gas + mist | 83 | 830 | 600 | 25 | 380 | Gas | 360 | 400 | — | Example |
| 6 | HB | B | 45 | 940 | 20 | 440 | Gas + mist | 83 | 830 | 600 | 25 | 380 | Gas | 360 | 400 | — | Example |
| 7 | HC | C | 55 | 850 | 20 | 380 | Gas | 85 | 760 | 720 | 20 | 410 | Gas | 400 | 100 | — | Example |
| 8 | HC | C | 55 | 850 | 20 | 380 | Gas | 85 | 800 | 720 | 20 | 410 | Gas | 400 | 100 | — | Example |
| 9 | HC | C | 55 | 850 | 20 | 380 | Gas | 85 | 840 | 720 | 20 | 410 | Gas | 400 | 100 | — | Example |
| 10 | HD | D | 35 | 900 | 15 | 360 | Gas | 93 | 840 | 30 | 10 | 360 | Gas + furnace cooling | 350 | 400 | — | Example |
| 11 | HD | D | 35 | 900 | 15 | 360 | Gas | 93 | 840 | 30 | 10 | 410 | Gas + furnace cooling | 400 | 400 | — | Example |
| 12 | HD | D | 35 | 900 | 15 | 360 | Gas | 93 | 840 | 30 | 10 | 460 | Gas + furnace cooling | 440 | 400 | — | Example |
| 13 | HE | E | 40 | 860 | 20 | 430 | Gas | 87 | 700 | 180 | 20 | 420 | Gas | 400 | 300 | GA | Example |
| 14 | HE | E | 40 | 860 | 20 | 430 | Gas | 87 | 740 | 180 | 20 | 420 | Gas | 400 | 300 | GA | Example |
| 15 | HE | E | 40 | 860 | 20 | 430 | Gas | 87 | 780 | 180 | 20 | 420 | Gas | 400 | 300 | GA | Example |
| 16 | HF | F | 80 | 920 | 15 | 350 | Gas | 81 | 810 | 220 | 30 | 380 | Gas + mist | 380 | 350 | GA | Example |
| 17 | HF | F | 80 | 920 | 15 | 400 | Gas | 81 | 810 | 220 | 30 | 380 | Gas + mist | 380 | 350 | GA | Example |
| 18 | HF | F | 80 | 920 | 15 | 450 | Gas | 81 | 810 | 220 | 30 | 380 | Gas + mist | 380 | 350 | GA | Example |

TABLE 3-continued

| | | | | Annealing step | | | | | | | | | | | | | |
|---|---|---|---|---|---|---|---|---|---|---|---|---|---|---|---|---|---|
| | | | | First annealing substep | | | | | Second annealing substep | | | | | | | | |
| Cold-rolled sheet No. | Hot-rolled sheet No. | Steel No. | Cold rolling Rolling reduction (%) | Annealing temperature T1 (° C.) | Average cooling rate (° C./s) | Cooling end temperature T2 (° C.) | Cooling means | M + B** fraction (volume %) | Annealing temperature T3 (° C.) | Annealing holding time (s) | Average cooling rate (° C./s) | Cooling end temperature T4 (° C.) | Cooling means | Holding temperature range (° C.) | Holding time (s) | Plating Type* | Remark |
| 19 | HG | G | 35 | 850 | 10 | 360 | Gas + furnace cooling | 80 | 770 | 80 | 15 | 430 | Gas | 420 | 550 | GI | Example |
| 20 | HG | G | 35 | 900 | 10 | 360 | Gas + furnace cooling | 80 | 770 | 80 | 15 | 430 | Gas | 420 | 550 | GI | Example |
| 21 | HG | G | 35 | 950 | 10 | 360 | Gas + furnace cooling | 80 | 770 | 80 | 15 | 430 | Gas | 420 | 550 | GI | Example |
| 22 | HH | H | 70 | 860 | 15 | 430 | Gas | 88 | 780 | 560 | 20 | 400 | Gas | 370 | 1700 | — | Example |
| 23 | HH | H | 70 | 860 | 15 | 470 | Gas | 88 | 780 | 560 | 20 | 400 | Gas | 370 | 1700 | — | Example |
| 24 | HH | H | 70 | 860 | 15 | 500 | Gas | 88 | 780 | 560 | 20 | 400 | Gas | 370 | 1700 | — | Example |

*GI: Hot-dip galvanizing, GA: Hot-dip galvannealing, EG: electrogalvanizing
**M: Martensite phase, B: Bainite phase

TABLE 4

| | | | | Annealing step | | | | | | | | | | | | | |
|---|---|---|---|---|---|---|---|---|---|---|---|---|---|---|---|---|---|
| | | | | First annealing substep | | | | | Second annealing substep | | | | | | | | |
| Cold-rolled sheet No. | Hot-rolled sheet No. | Steel No. | Cold rolling Rolling reduction (%) | Annealing temperature T1 (° C.) | Average cooling rate (° C./s) | Cooling end temperature T2 (° C.) | Cooling means | M + B** fraction (volume %) | Annealing temperature T3 (° C.) | Annealing holding time (s) | Average cooling rate (° C./s) | Cooling end temperature T4 (° C.) | Cooling means | Holding temperature range (° C.) | Holding time (s) | Plating Type* | Remark |
| 25 | HI | I | 45 | 850 | 25 | 380 | Gas + mist | 95 | 770 | 870 | 15 | 370 | Gas | 360 | 400 | — | Example |
| 26 | HI | I | 45 | 850 | 25 | 380 | Gas + mist | 95 | 820 | 870 | 15 | 370 | Gas | 360 | 400 | — | Example |
| 27 | HI | I | 45 | 850 | 25 | 380 | Gas + mist | 95 | 840 | 870 | 15 | 370 | Gas | 360 | 400 | — | Example |
| 28 | HJ | J | 60 | 820 | 10 | 420 | Gas | 94 | 780 | 620 | 10 | 350 | Gas | 350 | 300 | GA | Example |
| 29 | HJ | J | 60 | 820 | 10 | 420 | Gas | 94 | 780 | 620 | 10 | 400 | Gas | 380 | 300 | GA | Example |
| 30 | HJ | J | 60 | 820 | 10 | 420 | Gas | 94 | 780 | 620 | 10 | 450 | Gas | 430 | 300 | GA | Example |
| 31 | HK | K | 30 | 930 | 15 | 460 | Gas | 86 | 760 | 400 | 20 | 380 | Gas | 370 | 800 | GI | Example |
| 32 | HK | K | 30 | 930 | 15 | 460 | Gas | 86 | 810 | 400 | 20 | 380 | Gas | 370 | 800 | GI | Example |
| 33 | HK | K | 30 | 930 | 15 | 460 | Gas | 86 | 840 | 400 | 20 | 380 | Gas | 370 | 800 | GI | Example |
| 34 | HL | L | 65 | 900 | 20 | 350 | Gas | 81 | 750 | 700 | 20 | 420 | Gas | 390 | 50 | GA | Example |
| 35 | HL | L | 65 | 900 | 20 | 370 | Gas | 81 | 750 | 700 | 20 | 420 | Gas | 390 | 50 | GA | Example |
| 36 | HL | L | 65 | 900 | 20 | 420 | Gas | 81 | 750 | 700 | 20 | 420 | Gas | 390 | 50 | GA | Example |
| 37 | HM | M | 40 | 830 | 10 | 400 | Gas + furnace cooling | 85 | 830 | 230 | 15 | 370 | Gas + furnace cooling | 350 | 400 | GA | Example |
| 38 | HM | M | 40 | 880 | 10 | 400 | Gas + furnace cooling | 85 | 830 | 230 | 15 | 370 | Gas + furnace cooling | 350 | 400 | GA | Example |
| 39 | HM | M | 40 | 930 | 10 | 400 | Gas + furnace cooling | 85 | 830 | 230 | 15 | 370 | Gas + furnace cooling | 350 | 400 | GA | Example |
| 40 | HN | N | 90 | 860 | 25 | 440 | Gas | 90 | 770 | 70 | 15 | 390 | Gas | 380 | 300 | — | Example |
| 41 | HN | N | 90 | 860 | 25 | 480 | Gas | 90 | 770 | 70 | 15 | 390 | Gas | 380 | 300 | — | Example |
| 42 | HN | N | 90 | 860 | 25 | 500 | Gas | 90 | 770 | 70 | 15 | 390 | Gas | 380 | 300 | — | Example |
| 43 | HO | O | 45 | 850 | 20 | 360 | Gas | 87 | 750 | 540 | 15 | 380 | Gas | 350 | 250 | — | Example |
| 44 | HO | O | 45 | 850 | 20 | 360 | Gas | 87 | 800 | 540 | 15 | 380 | Gas | 350 | 250 | — | Example |
| 45 | HO | O | 45 | 850 | 20 | 360 | Gas | 87 | 840 | 540 | 15 | 380 | Gas | 350 | 250 | — | Example |
| 46 | HP | P | 60 | 820 | 10 | 430 | Gas | 85 | 780 | 740 | 15 | 380 | Gas | 350 | 300 | — | Example |

TABLE 4-continued

| | | | | Annealing step | | | | | | | | | | | | | |
|---|---|---|---|---|---|---|---|---|---|---|---|---|---|---|---|---|---|
| | | | | First annealing substep | | | | | Second annealing substep | | | | | | | | |
| Cold-rolled sheet No. | Hot-rolled sheet No. | Steel No. | Cold rolling Rolling reduction (%) | Annealing temperature T1 (° C.) | Average cooling rate (° C./s) | Cooling end temperature T2 (° C.) | Cooling means | M + B** fraction (volume %) | Annealing temperature T3 (° C.) | Annealing holding time (s) | Average cooling rate (° C./s) | Cooling end temperature T4 (° C.) | Cooling means | Holding temperature range (° C.) | Holding time (s) | Plating Type* | Remark |
| 47 | HP | P | 60 | 820 | 10 | 430 | Gas | 85 | 780 | 740 | 15 | 430 | Gas | 390 | 300 | — | Example |
| 48 | HP | P | 60 | 820 | 10 | 430 | Gas | 85 | 780 | 740 | 15 | 470 | Gas | 440 | 300 | — | Example |

*GI: Hot-dip galvanizing, GA: Hot-dip galvannealing, EG: electrogalvanizing

**M: Martensite phase, B: Bainite phase

TABLE 5

| | | | | Annealing step | | | | | | | | | | | | | |
|---|---|---|---|---|---|---|---|---|---|---|---|---|---|---|---|---|---|
| | | | | First annealing substep | | | | | Second annealing substep | | | | | | | | |
| Cold-rolled sheet No. | Hot-rolled sheet No. | Steel No. | Cold rolling Rolling reduction (%) | Annealing temperature T1 (° C.) | Average cooling rate (° C./s) | Cooling end temperature T2 (° C.) | Cooling means | M + B** fraction (volume %) | Annealing temperature T3 (° C.) | Annealing holding time (s) | Average cooling rate (° C./s) | Cooling end temperature T4 (° C.) | Cooling means | Holding temperature range (° C.) | Holding time (s) | Plating Type* | Remark |
| 49 | HQ | Q | 50 | 890 | 15 | 400 | Gas | 96 | 760 | 20 | 20 | 420 | Gas | 390 | 150 | — | Example |
| 50 | HQ | Q | 50 | 890 | 15 | 400 | Gas | 96 | 810 | 20 | 20 | 420 | Gas | 390 | 150 | — | Example |
| 51 | HQ | Q | 50 | 890 | 15 | 400 | Gas | 96 | 840 | 20 | 20 | 420 | Gas | 390 | 150 | — | Example |
| 52 | HR | R | 40 | 860 | 15 | 370 | Gas + furnace cooling | 91 | 780 | 440 | 20 | 400 | Gas | 380 | 300 | — | Comparative Example |
| 53 | HR | R | 40 | 860 | 15 | 420 | Gas + furnace cooling | 91 | 780 | 440 | 20 | 400 | Gas | 380 | 300 | — | Comparative Example |
| 54 | HR | R | 40 | 860 | 15 | 460 | Gas + furnace cooling | 91 | 780 | 440 | 20 | 400 | Gas | 380 | 300 | — | Comparative Example |
| 55 | HS | S | 35 | 800 | 20 | 430 | Gas | 94 | 800 | 310 | 20 | 410 | Gas | 380 | 250 | GA | Comparative Example |
| 56 | HS | S | 35 | 840 | 20 | 430 | Gas | 94 | 800 | 310 | 20 | 410 | Gas | 380 | 250 | GA | Comparative Example |
| 57 | HS | S | 35 | 880 | 20 | 430 | Gas | 94 | 800 | 310 | 20 | 410 | Gas | 380 | 250 | GA | Comparative Example |
| 58 | HT | T | 70 | 830 | 20 | 370 | Gas | 82 | 790 | 800 | 15 | 370 | Gas | 350 | 400 | GI | Comparative Example |
| 59 | HT | T | 70 | 830 | 20 | 400 | Gas | 82 | 790 | 800 | 15 | 370 | Gas | 350 | 400 | GI | Comparative Example |
| 60 | HT | T | 70 | 830 | 20 | 430 | Gas | 82 | 790 | 800 | 15 | 370 | Gas | 350 | 400 | GI | Comparative Example |
| 61 | HU | U | 60 | 850 | 10 | 380 | Gas | 81 | 770 | 610 | 15 | 380 | Gas | 350 | 350 | GI | Comparative Example |
| 62 | HU | U | 60 | 850 | 10 | 380 | Gas | 81 | 820 | 610 | 15 | 380 | Gas | 350 | 350 | GI | Comparative Example |
| 63 | HU | U | 60 | 850 | 10 | 380 | Gas | 81 | 840 | 610 | 15 | 380 | Gas | 350 | 350 | GI | Comparative Example |
| 64 | HV | V | 65 | 890 | 15 | 400 | Gas | 90 | 800 | 420 | 15 | 370 | Gas | 350 | 300 | EG | Comparative Example |
| 65 | HV | V | 65 | 890 | 15 | 400 | Gas | 90 | 800 | 420 | 15 | 420 | Gas | 400 | 300 | EG | Comparative Example |
| 66 | HV | V | 65 | 890 | 15 | 400 | Gas | 90 | 800 | 420 | 15 | 470 | Gas | 450 | 300 | EG | Comparative Example |
| 67 | HW | W | 75 | 910 | 10 | 410 | Gas | 86 | 730 | 400 | 10 | 430 | Gas | 400 | 1200 | — | Comparative Example |
| 68 | HW | W | 75 | 910 | 10 | 410 | Gas | 86 | 770 | 400 | 10 | 430 | Gas | 400 | 1200 | — | Comparative Example |
| 69 | HW | W | 75 | 910 | 10 | 410 | Gas | 86 | 820 | 400 | 10 | 430 | Gas | 400 | 1200 | — | Comparative Example |
| 70 | HX | X | 65 | 820 | 10 | 450 | Gas | 85 | 780 | 300 | 15 | 440 | Gas | 430 | 400 | — | Comparative Example |

TABLE 5-continued

| | | | | Annealing step | | | | | | | | | | | | | |
|---|---|---|---|---|---|---|---|---|---|---|---|---|---|---|---|---|---|
| | | | | First annealing substep | | | | | Second annealing substep | | | | | | | | |
| Cold-rolled sheet No. | Hot-rolled sheet No. | Steel No. | Cold rolling Rolling reduction (%) | Annealing temperature T1 (° C.) | Average cooling rate (° C./s) | Cooling end temperature T2 (° C.) | Cooling means | M + B** fraction (volume %) | Annealing temperature T3 (° C.) | Annealing holding time (s) | Average cooling rate (° C./s) | Cooling end temperature T4 (° C.) | Cooling means | Holding temperature range (° C.) | Holding time (s) | Plating Type* | Remark |
| 71 | HX | X | 65 | 870 | 10 | 450 | Gas | 87 | 780 | 300 | 15 | 440 | Gas | 430 | 400 | — | Comparative Example |
| 72 | HX | X | 65 | 920 | 10 | 450 | Gas | 96 | 780 | 300 | 15 | 440 | Gas | 430 | 400 | — | Comparative Example |

*GI: Hot-dip galvanizing, GA: Hot-dip galvannealing and alloying, EG: electrogalvanizing
**M: Martensite phase, B: Bainite phase

TABLE 6

| | | | | Annealing step | | | | | | | | | | | | | |
|---|---|---|---|---|---|---|---|---|---|---|---|---|---|---|---|---|---|
| | | | | First annealing substep | | | | | Second annealing substep | | | | | | | | |
| Cold-rolled sheet No. | Hot-rolled sheet No. | Steel No. | Cold rolling Rolling reduction (%) | Annealing temperature T1 (° C.) | Average cooling rate (° C./s) | Cooling end temperature T2 (° C.) | Cooling means | M + B** fraction (volume %) | Annealing temperature T3 (° C.) | Annealing holding time (s) | Average cooling rate (° C./s) | Cooling end temperature T4 (° C.) | Cooling means | Holding temperature range (° C.) | Holding time (s) | Plating Type* | Remark |
| 73 | HY | Y | 75 | 880 | 15 | 400 | Gas + furnace cooling | 82 | 760 | 50 | 15 | 390 | Gas | 360 | 600 | GI | Comparative Example |
| 74 | HY | Y | 75 | 880 | 15 | 450 | Gas + furnace cooling | 82 | 760 | 50 | 15 | 390 | Gas | 360 | 600 | GI | Comparative Example |
| 75 | HY | Y | 75 | 880 | 15 | 500 | Gas + furnace cooling | 82 | 760 | 50 | 15 | 390 | Gas | 360 | 600 | GI | Comparative Example |
| 76 | HZ | Z | 65 | 900 | 15 | 420 | Gas | 83 | 730 | 500 | 20 | 420 | Gas + mist | 400 | 800 | — | Comparative Example |
| 77 | HZ | Z | 65 | 900 | 15 | 420 | Gas | 83 | 780 | 500 | 20 | 420 | Gas + mist | 400 | 800 | — | Comparative Example |
| 78 | HZ | Z | 65 | 900 | 15 | 420 | Gas | 83 | 830 | 500 | 20 | 420 | Gas + mist | 400 | 800 | — | Comparative Example |
| 79 | HAA | AA | 45 | 890 | 10 | 400 | Gas | 87 | 810 | 580 | 15 | 380 | Gas | 360 | 450 | — | Comparative Example |
| 80 | HAA | AA | 45 | 890 | 10 | 400 | Gas | 87 | 810 | 580 | 15 | 420 | Gas | 400 | 450 | — | Comparative Example |
| 81 | HAA | AA | 45 | 890 | 10 | 400 | Gas | 87 | 810 | 580 | 15 | 470 | Gas | 450 | 450 | — | Comparative Example |
| 82 | HAB | AB | 65 | 870 | 10 | 380 | Gas | 90 | 750 | 800 | 15 | 400 | Gas | 370 | 600 | — | Comparative Example |
| 83 | HAB | AB | 65 | 870 | 10 | 380 | Gas | 90 | 750 | 800 | 15 | 450 | Gas | 420 | 600 | — | Comparative Example |
| 84 | HAB | AB | 65 | 870 | 10 | 380 | Gas | 90 | 750 | 800 | 15 | 500 | Gas | 470 | 600 | — | Comparative Example |

*GI: Hot-dip galvanizing GA: Hot-dip galvannealing and alloying, EG: electrogalvanizing
**M: Martensite phase, B: Bainite phase

TABLE 7

| | | | | Annealing step | | | | | | | | | | | | | |
|---|---|---|---|---|---|---|---|---|---|---|---|---|---|---|---|---|---|
| | | | | First annealing substep | | | | | Second annealing substep | | | | | | | | |
| Cold-rolled sheet No. | Hot-rolled sheet No. | Steel No. | Cold rolling Rolling reduction (%) | Annealing temperature T1 (° C.) | Average cooling rate (° C./s) | Cooling end temperature T2 (° C.) | Cooling means | M + B** fraction (volume %) | Annealing temperature T3 (° C.) | Annealing holding time (s) | Average cooling rate (° C./s) | Cooling end temperature T4 (° C.) | Cooling means | Holding temperature range (° C.) | Holding time (s) | Plating Type* | Remark |
| 85 | HA1 | A | 15 | 840 | 10 | 400 | Gas | 84 | 780 | 810 | 10 | 460 | Gas | 430 | 300 | — | Comparative Example |
| 86 | HA2 | A | 35 | 760 | 10 | 360 | Gas | 54 | 800 | 400 | 15 | 390 | Gas | 360 | 400 | GI | Comparative Example |
| 87 | HA5 | A | 50 | 960 | 25 | 400 | Gas + mist | 90 | 770 | 200 | 20 | 420 | Gas | 400 | 300 | GI | Comparative Example |
| 88 | HA9 | A | 70 | 900 | 3 | 390 | Gas + furnace cooling | 32 | 840 | 270 | 15 | 400 | Gas | 380 | 900 | GA | Comparative Example |
| 89 | HA3 | A | 40 | 860 | 10 | 300 | Gas | 85 | 790 | 100 | 10 | 460 | Gas | 430 | 200 | — | Comparative Example |
| 90 | HA9 | A | 70 | 820 | 15 | 550 | Gas | 65 | 770 | 680 | 20 | 410 | Gas | 400 | 500 | — | Comparative Example |
| 91 | HA4 | A | 45 | 860 | 20 | 430 | Gas | 88 | 640 | 320 | 25 | 380 | Gas | 360 | 200 | — | Comparative Example |
| 92 | HA0 | A | 75 | 890 | 20 | 400 | Gas | 81 | 870 | 840 | 20 | 450 | Gas | 440 | 300 | — | Comparative Example |
| 93 | HA2 | A | 35 | 810 | 10 | 480 | Gas | 87 | 770 | 5 | 10 | 420 | Gas | 400 | 600 | GA | Comparative Example |
| 94 | HA9 | A | 70 | 930 | 15 | 370 | Gas | 90 | 830 | 1300 | 20 | 370 | Gas | 350 | 300 | GI | Comparative Example |
| 95 | HA7 | A | 60 | 890 | 10 | 410 | Gas | 93 | 780 | 400 | 2 | 400 | Gas + furnace cooling | 380 | 400 | GI | Comparative Example |
| 96 | HA4 | A | 45 | 830 | 15 | 420 | Gas | 91 | 800 | 350 | 70 | 390 | Gas + mist | 380 | 350 | — | Comparative Example |
| 97 | HA5 | A | 50 | 880 | 25 | 380 | Gas | 91 | 820 | 80 | 20 | 300 | Gas | 300 | 450 | GA | Comparative Example |
| 98 | HA0 | A | 75 | 860 | 10 | 450 | Gas | 84 | 800 | 60 | 10 | 530 | Gas | 510 | 500 | — | Comparative Example |
| 99 | HA8 | A | 65 | 900 | 15 | 430 | Gas | 86 | 790 | 140 | 15 | 420 | Gas | 410 | 5 | GI | Comparative Example |
| 100 | HA6 | A | 55 | 870 | 20 | 420 | Gas | 88 | 810 | 240 | 20 | 450 | Gas | 430 | 2000 | — | Comparative Example |
| 101 | HA8 | A | 65 | 860 | 2 | 480 | Gas + mist | 25 | 730 | 100 | 10 | 370 | Gas | 360 | 1000 | GA | Comparative Example |
| 102 | HA8 | A | 65 | 860 | 2 | 480 | Gas + mist | 25 | 780 | 100 | 10 | 370 | Gas | 360 | 1000 | GA | Comparative Example |
| 103 | HA8 | A | 65 | 860 | 2 | 480 | Gas + mist | 25 | 830 | 100 | 10 | 370 | Gas | 360 | 1000 | GA | Comparative Example |

*GI: Hot-dip galvanizing, GA: Hot-dip galvannealing, EG: electrogalvanizing

**M: Martensite phase, B: Bainite phase

A test specimen was taken from each of the thin cold-rolled steel sheets (including the thin hot-dip galvanized steel sheets, the thin hot-dip galvannealed steel sheets, and the thin electrogalvanized steel sheets). The test specimens were inspected for microstructure and subjected to a tensile test by the following methods.

(1) Inspection of Microstructure

A test specimen for microstructure inspection was taken from each of the thin cold-rolled steel sheets subjected to the annealing step (first and second annealing substeps) or the set of the annealing step and the following plating treatment. The test specimens were each ground such that the position corresponding to ¼ of the thickness of the steel sheet in the rolling-direction cross section (L-cross section) was observed. After the cross sections of the test specimens had been corroded (3-vol % nital corrosion), they were each inspected for microstructure with a scanning electron microscope SEM (magnification: 2000 times) in 10 or more fields of view, and SEM images were captured. The microstructure fraction (area ratio) of each phase was determined from each of the SEM images by image analysis and treated as the volume fraction of the phase. Thus, the microstructure fractions of phases in each of the steel sheets were determined. Analysis software used in the image analysis was "Image-Pro" (product name) produced by Media Cybernetics. Since the ferrite phase is gray and the martensite phase and the retained austenite phase are white in SEM images, the type of phase was determined from the tone of color of the phase. A microstructure including the ferrite phase and fine retained austenite grains or fine cementite grains present in the ferrite phase in a dot-like or linear pattern was considered to be the bainite phase. The pearlite phase and the cementite phase were identified on the basis of the type of microstructure. The volume fraction of the martensite phase was determined by subtracting the volume fraction of the retained austenite phase, which had been calculated in advance, from the volume fraction of the white phases.

A test specimen for X-ray diffraction was taken from each of the thin cold-rolled steel sheets that had been subjected to the annealing step (first and second annealing substeps) or the set of the annealing step and the following plating treatment. The test specimens were each ground and polished such that the position corresponding to ¼ of the thickness of the steel sheet was observed. The amount of retained austenite was determined from the intensity of the diffracted X-ray by X-ray diffraction analysis. The incident X-ray used was CoKα radiation. The amount of retained austenite was calculated in the following manner. The intensity ratio between each of all the possible combinations of the peak integrated intensities of {111}, {200}, {220}, and {311} planes of austenite and the peak integrated intensities of the {110}, {200}, and {211} planes of ferrite was calculated. From the average of the intensity ratios, the amount (volume fraction) of retained austenite in each steel sheet was calculated.

A test specimen for transmission electron microscope observation was taken from each of the thin cold-rolled steel sheets subjected to the annealing step (first and second annealing substeps) or the set of the annealing step and the following plating treatment. The test specimens were each ground and polished (mechanical polishing and electrolytic polishing) such that the position corresponding to ¼ of the thickness of the steel sheet was observed. The resulting thin-film test specimens were each inspected for microstructure with a transmission electron microscope TEM (magnification: 15000 times). TEM images were taken in 20 or more fields of view. The average crystal grain diameter of the retained austenite phase and the average aspect ratio of the crystal grains were determined from the TEM images by image analysis. The average crystal grain diameter of the retained austenite phase was determined as follows. The area of each crystal grain of the retained austenite phase was measured. The equivalent circle diameter of each crystal grain was calculated from the area of the crystal grain. The arithmetic average of the equivalent circle diameters of the crystal grains was defined as the average crystal grain diameter of the retained austenite phase in the steel sheet. 20 or more crystal grains of the retained austenite phase were measured in each field of view to determine the average crystal grain diameter of the retained austenite phase. The longer and shorter axes of each crystal grains of the retained austenite phase were measured from the TEM images by image analysis to determine the aspect ratio of the crystal grain of the retained austenite phase. The arithmetic average of the aspect ratios of the crystal grains was defined as the (average) aspect ratio of the crystal grains of the retained austenite phase included in the steel sheet. Analysis software used in the image analysis of the TEM images was "Image-Pro" (product name) produced by Media Cybernetics.

(2) Tensile Test

A JIS No. 5 tensile test specimen was taken from each of the thin cold-rolled steel sheets that had been subjected to the annealing step (first and second annealing substeps) or the set of the annealing step and the following plating treatment such that the tensile direction of the test specimen was equal to the direction (C direction) perpendicular to the rolling direction. The test specimens were each subjected to a tensile test confirming to JIS Z 2241 (2011) to determine the tensile properties (yield strength YS, tensile strength TS, and total elongation El) of the test specimen. The strength-ductility balance TS×El of each test specimen was also determined from the tensile properties of the test specimen. A steel sheet of the TS 980 MPa grade when having an El of 20% or more and a TS×El of 19600 MPa·% or more was evaluated as a steel sheet having good strength-ductility balance. A steel sheet of the TS 1180 MPa grade when having an El of 15% or more and a TS×El of 17700 MPa·% or more was evaluated as a steel sheet having good strength-ductility balance. A steel sheet of the TS 1270 MPa grade when having an El of 10% or more and a TS×El of 12700 MPa·% or more was evaluated as a steel sheet having good strength-ductility balance. An evaluation grade of "0" was given to the above steel sheets. An evaluation grade of "x" was given to the other steel sheets.

Two JIS No. 5 tensile test specimens were also taken from each of the thin cold-rolled steel sheets such that the tensile direction of one of the test specimens was equal to the direction (L direction) parallel to the rolling direction and the tensile direction of the other test specimen was equal to the direction (D direction) inclined at an angle of 45° with respect to the rolling direction. The above test specimens were also each subjected to the tensile test confirming to JIS Z 2241 (2011) to determine the tensile strength TS and total elongation El of the test specimen.

δTS and δEl defined by Expressions (1) and (2) below were calculated from the tensile strength TS and the total elongation El of each steel sheet to evaluate in-plane anisotropies in terms of strength and elongation, $$\delta TS=(TS_L+TS_C-2\times TS_D)/2 \quad (1)$$

(where δTS: in-plane anisotropy (MPa) in terms of tensile strength TS, $TS_L$: tensile strength (MPa) in the direction (L direction) parallel to the rolling direction, $TS_C$: tensile strength (MPa) in the direction (C direction) perpendicular to the rolling direction, and $TS_D$: tensile strength (MPa) in the direction (D direction) inclined at an angle of 45° with respect to the rolling direction), $$\delta El=(El_L+El_C-2\times El_D)/2 \quad (2)$$

(where δEl: in-plane anisotropy (%) in terms of total elongation El, $El_L$: total elongation (%) in the direction (L direction) parallel to the rolling direction, $El_C$: total elongation (%) in the direction (C direction) perpendicular to the rolling direction, and $El_D$: total elongation (%) in the direction (D direction) inclined at an angle of 45° with respect to the rolling direction). When the value of $(TS_L+TS_C-2\times TS_D)$ or $(El_L+El_C-2\times El_D)$ was negative, the absolute value thereof was taken. Steel sheets having a δTS of 25 MPa or less and a δEl of 10% or less were evaluated as a steel sheet having small in-plane anisotropies. An evaluation grade of "○" was given to such steel sheets. An evaluation grade of "x" was given to the other steel sheets.

Tables 8 to 12 show the results.

TABLE 8

| Cold-rolled sheet No. | Hot-rolled sheet No. | Steel No. | Microstructure: Type* | Microstructure fractions (volume %): F | γ | M | Retained γ: Average grain diameter (μm) | Aspect ratio | Tensile properties: YS (MPa) | TS (Mpa) | El (%) | TS × El (Mpa %) | In-plane anisotropy: δTS (Mpa) | δEl (%) | Evaluation | Remark |
|---|---|---|---|---|---|---|---|---|---|---|---|---|---|---|---|---|
| 1 | HA5 | A | F + γ + M | 53 | 24 | 23 | 1.4 | 2.2 | 689 | 1056 | 28.9 | 30518 | 17 | 7 | ○ | Example |
| 2 | HA5 | A | F + γ + M | 50 | 20 | 30 | 1.6 | 2.3 | 640 | 1007 | 31.2 | 31418 | 20 | 7 | ○ | Example |
| 3 | HA5 | A | F + γ + M | 53 | 18 | 29 | 1.5 | 2.5 | 610 | 994 | 33.0 | 32802 | 22 | 5 | ○ | Example |
| 4 | HB | B | F + γ + M | 46 | 26 | 28 | 1.2 | 2.3 | 580 | 1084 | 28.1 | 30460 | 20 | 9 | ○ | Example |
| 5 | HB | B | F + γ + M | 55 | 17 | 28 | 1.5 | 2.1 | 520 | 1035 | 26.3 | 27221 | 12 | 5 | ○ | Example |
| 6 | HB | B | F + γ + M | 57 | 20 | 23 | 1.7 | 2.2 | 562 | 1045 | 25.9 | 27066 | 8 | 4 | ○ | Example |
| 7 | HC | C | F + γ + M | 51 | 23 | 26 | 1.2 | 2.3 | 554 | 996 | 26.7 | 26593 | 13 | 8 | ○ | Example |
| 8 | HC | C | F + γ + M | 56 | 17 | 27 | 1.3 | 2.4 | 471 | 1034 | 21.5 | 22231 | 16 | 6 | ○ | Example |
| 9 | HC | C | F + γ + M | 61 | 16 | 23 | 1.6 | 2.4 | 587 | 1068 | 20.8 | 22214 | 10 | 6 | ○ | Example |
| 10 | HD | D | F + γ + M | 65 | 18 | 17 | 1.3 | 2.2 | 540 | 1182 | 18.7 | 22103 | 20 | 7 | ○ | Example |
| 11 | HD | D | F + γ + M | 54 | 22 | 24 | 1.8 | 2.6 | 517 | 1187 | 17.0 | 20179 | 23 | 3 | ○ | Example |
| 12 | HD | D | F + γ + M | 48 | 24 | 28 | 1.4 | 2.5 | 604 | 1224 | 15.4 | 18850 | 18 | 6 | ○ | Example |
| 13 | HE | E | F + γ + M | 44 | 27 | 29 | 1.2 | 2.2 | 543 | 1184 | 22.3 | 26403 | 16 | 3 | ○ | Example |
| 14 | HE | E | F + γ + M | 50 | 21 | 29 | 1.6 | 2.4 | 580 | 1195 | 19.7 | 23542 | 21 | 4 | ○ | Example |
| 15 | HE | E | F + γ + M | 53 | 18 | 29 | 1.8 | 2.5 | 631 | 1218 | 17.0 | 20706 | 22 | 3 | ○ | Example |
| 16 | HF | F | F + γ + M | 57 | 20 | 23 | 1.8 | 2.2 | 741 | 1340 | 11.0 | 14740 | 9 | 7 | ○ | Example |
| 17 | HF | F | F + γ + M + C | 52 | 17 | 27 | 1.4 | 2.1 | 735 | 1294 | 13.2 | 17081 | 11 | 5 | ○ | Example |
| 18 | HF | F | F + γ + M | 60 | 17 | 23 | 1.5 | 2.4 | 704 | 1281 | 15.0 | 19215 | 17 | 8 | ○ | Example |
| 19 | HG | G | F + γ + M | 51 | 20 | 29 | 1.4 | 2.3 | 704 | 1341 | 10.9 | 14617 | 15 | 9 | ○ | Example |
| 20 | HG | G | F + γ + M | 55 | 16 | 29 | 1.3 | 2.3 | 682 | 1302 | 11.3 | 14713 | 15 | 8 | ○ | Example |
| 21 | HG | G | F + γ + M + C | 57 | 16 | 25 | 1.8 | 2.4 | 645 | 1273 | 13.1 | 16676 | 19 | 5 | ○ | Example |
| 22 | HH | H | F + γ + M | 54 | 20 | 26 | 1.4 | 2.2 | 576 | 1191 | 18.9 | 22510 | 13 | 7 | ○ | Example |
| 23 | HH | H | F + γ + M | 53 | 18 | 29 | 1.2 | 2.6 | 595 | 1232 | 16.4 | 20205 | 9 | 7 | ○ | Example |
| 24 | HH | H | F + γ + M | 53 | 18 | 29 | 1.6 | 2.4 | 620 | 1269 | 15.4 | 19543 | 17 | 6 | ○ | Example |

*F: Ferrite phase, M: Martensite phase, γ: Retained austenite phase, P: Pearlite, C: Cementite

TABLE 9

| Cold-rolled sheet No. | Hot-rolled sheet No. | Steel No. | Microstructure: Type* | Microstructure fractions (volume %): F | γ | M | Retained γ: Average grain diameter (μm) | Aspect ratio | Tensile properties: YS (MPa) | TS (Mpa) | El (%) | TS × El (Mpa %) | In-plane anisotropy: δTS (Mpa) | δEl (%) | Evaluation | Remark |
|---|---|---|---|---|---|---|---|---|---|---|---|---|---|---|---|---|
| 25 | HI | I | F + γ + M | 52 | 24 | 24 | 1.6 | 2.7 | 701 | 1197 | 20.7 | 24778 | 15 | 8 | ○ | Example |
| 26 | HI | I | F + γ + M | 54 | 20 | 26 | 1.9 | 2.4 | 731 | 1204 | 18.4 | 22154 | 8 | 9 | ○ | Example |
| 27 | HI | I | F + γ + M + C | 55 | 18 | 24 | 1.8 | 2.2 | 782 | 1265 | 16.4 | 20746 | 12 | 9 | ○ | Example |
| 28 | HJ | J | F + γ + M | 60 | 19 | 21 | 1.5 | 2.4 | 548 | 1099 | 26.4 | 29014 | 11 | 3 | ○ | Example |
| 29 | HJ | J | F + γ + M | 58 | 16 | 26 | 1.3 | 2.1 | 596 | 1160 | 23.6 | 27376 | 6 | 2 | ○ | Example |
| 30 | HJ | J | F + γ + M | 59 | 16 | 25 | 1.6 | 2.3 | 643 | 1172 | 22.1 | 25901 | 5 | 2 | ○ | Example |
| 31 | HK | K | F + γ + M | 49 | 26 | 25 | 1.4 | 2.2 | 557 | 1037 | 28.1 | 29140 | 9 | 3 | ○ | Example |
| 32 | HK | K | F + γ + M + C | 55 | 21 | 22 | 1.7 | 2.6 | 573 | 1095 | 25.5 | 27923 | 12 | 4 | ○ | Example |
| 33 | HK | K | F + γ + M + C | 52 | 17 | 27 | 1.8 | 2.4 | 621 | 1115 | 22.1 | 24642 | 14 | 7 | ○ | Example |
| 34 | HL | L | F + γ + M | 58 | 18 | 24 | 1.2 | 2.3 | 694 | 1204 | 17.0 | 20468 | 15 | 8 | ○ | Example |
| 35 | HL | L | F + γ + M | 53 | 18 | 29 | 1.4 | 2.2 | 658 | 1186 | 18.0 | 21348 | 18 | 5 | ○ | Example |
| 36 | HL | L | F + γ + M | 52 | 22 | 26 | 1.7 | 2.5 | 632 | 1182 | 19.6 | 23167 | 20 | 7 | ○ | Example |
| 37 | HM | M | F + γ + M | 54 | 16 | 30 | 1.5 | 2.2 | 604 | 1310 | 10.4 | 13624 | 15 | 8 | ○ | Example |
| 38 | HM | M | F + γ + M | 60 | 17 | 23 | 1.6 | 2.4 | 567 | 1293 | 12.8 | 16550 | 12 | 6 | ○ | Example |
| 39 | HM | M | F + γ + M | 50 | 20 | 30 | 1.8 | 2.3 | 573 | 1287 | 14.1 | 18147 | 17 | 5 | ○ | Example |
| 40 | HN | N | F + γ + M | 59 | 16 | 25 | 1.6 | 2.2 | 600 | 1102 | 23.1 | 25456 | 17 | 3 | ○ | Example |
| 41 | HN | N | F + γ + M | 57 | 16 | 27 | 1.7 | 2.3 | 532 | 1058 | 28.4 | 30047 | 22 | 1 | ○ | Example |
| 42 | HN | N | F + γ + M | 68 | 23 | 9 | 1.4 | 2.6 | 540 | 1034 | 30.2 | 31227 | 23 | 2 | ○ | Example |
| 43 | HO | O | F + γ + M | 55 | 25 | 20 | 1.6 | 2.8 | 644 | 1164 | 22.4 | 26074 | 19 | 4 | ○ | Example |
| 44 | HO | O | F + γ + M | 62 | 18 | 20 | 1.8 | 2.4 | 594 | 1136 | 24.5 | 27832 | 14 | 3 | ○ | Example |
| 45 | HO | O | F + γ + M + C | 54 | 16 | 26 | 1.4 | 2.2 | 580 | 1087 | 28.0 | 30436 | 9 | 7 | ○ | Example |
| 46 | HP | P | F + γ + M | 52 | 18 | 30 | 1.2 | 2.5 | 667 | 1240 | 15.7 | 19468 | 8 | 8 | ○ | Example |
| 47 | HP | P | F + γ + M | 57 | 16 | 27 | 1.3 | 2.3 | 630 | 1185 | 17.3 | 20501 | 4 | 7 | ○ | Example |
| 48 | HP | P | F + γ + M | 57 | 17 | 26 | 1.6 | 2.1 | 573 | 1182 | 16.9 | 19976 | 5 | 4 | ○ | Example |

*F: Ferrite phase, M: Martensite phase, γ: Retained austenite phase, P: Pearlite, C: Cementite

TABLE 10

| Cold-rolled sheet No. | Hot-rolled sheet No. | Steel No. | Microstructure: Type* | Microstructure fractions (volume %): F | γ | M | Retained γ: Average grain diameter (μm) | Aspect ratio | Tensile properties: YS (MPa) | TS (Mpa) | El (%) | TS × El (Mpa %) | In-plane anisotropy: δTS (Mpa) | δEl (%) | Evaluation | Remark |
|---|---|---|---|---|---|---|---|---|---|---|---|---|---|---|---|---|
| 49 | HQ | Q | F + γ + M | 60 | 27 | 13 | 1.3 | 2.5 | 534 | 1034 | 33.0 | 34122 | 15 | 6 | ○ | Example |
| 50 | HQ | Q | F + γ + M | 54 | 18 | 28 | 1.7 | 2.2 | 596 | 1083 | 26.8 | 29024 | 15 | 5 | ○ | Example |
| 51 | HQ | Q | F + γ + M | 59 | 16 | 25 | 1.8 | 2.3 | 641 | 1120 | 22.6 | 25312 | 12 | 4 | ○ | Example |
| 52 | HR | R | F + γ + M | 60 | 12 | 28 | 1.4 | 2.2 | 540 | 903 | 36.8 | 33230 | 19 | 8 | ○ | Comparative Example |
| 53 | HR | R | F + γ + M | 64 | 12 | 24 | 1.6 | 2.3 | 565 | 873 | 33.8 | 29507 | 17 | 9 | ○ | Comparative Example |
| 54 | HR | R | F + γ + M | 62 | 9 | 29 | 1.8 | 2.1 | 581 | 891 | 32.4 | 28868 | 11 | 5 | ○ | Comparative Example |
| 55 | HS | S | F + γ + M | 45 | 28 | 27 | 1.6 | 2.4 | 789 | 1406 | 6.1 | 8577 | 16 | 8 | ○ | Comparative Example |
| 56 | HS | S | F + γ + M | 48 | 23 | 29 | 1.4 | 2.2 | 762 | 1357 | 8.5 | 11535 | 16 | 5 | ○ | Comparative Example |
| 57 | HS | S | F + γ + M | 50 | 22 | 28 | 1.6 | 2.1 | 770 | 1343 | 5.9 | 7924 | 21 | 6 | ○ | Comparative Example |
| 58 | HT | T | F + γ + M + C | 58 | 10 | 27 | 1.2 | 2.2 | 657 | 933 | 24.8 | 23138 | 8 | 8 | ○ | Comparative Example |
| 59 | HT | T | F + γ + M + C | 55 | 13 | 28 | 1.9 | 2.4 | 621 | 950 | 23.6 | 19570 | 15 | 8 | ○ | Comparative Example |
| 60 | HT | T | F + γ + M + C | 61 | 11 | 25 | 1.6 | 2.4 | 634 | 961 | 20.4 | 19604 | 14 | 5 | ○ | Comparative Example |
| 61 | HU | U | F + γ + M | 65 | 10 | 25 | 1.7 | 2.2 | 632 | 1090 | 8.2 | 8938 | 22 | 6 | ○ | Comparative Example |
| 62 | HU | U | F + γ + M | 64 | 8 | 28 | 1.9 | 2.3 | 590 | 1056 | 7.9 | 8342 | 17 | 4 | ○ | Comparative Example |
| 63 | HU | U | F + γ + M | 66 | 5 | 29 | 1.6 | 2.3 | 574 | 1008 | 14.9 | 15019 | 14 | 7 | ○ | Comparative Example |
| 64 | HV | V | F + γ + M | 65 | 7 | 28 | 1.3 | 2.4 | 630 | 1084 | 15.9 | 17236 | 17 | 6 | ○ | Comparative Example |
| 65 | HV | V | F + γ + M | 69 | 5 | 26 | 1.0 | 2.1 | 607 | 1022 | 18.1 | 18498 | 19 | 6 | ○ | Comparative Example |
| 66 | HV | V | F + γ + M | 66 | 5 | 29 | 1.1 | 2.1 | 576 | 1009 | 19.0 | 19171 | 16 | 4 | ○ | Comparative Example |
| 67 | HW | W | F + γ + M | 30 | 14 | 56 | 1.3 | 2.2 | 710 | 1387 | 9.0 | 12483 | 20 | 6 | ○ | Comparative Example |
| 68 | HW | W | F + γ + M | 32 | 13 | 55 | 1.2 | 2.5 | 705 | 1410 | 7.5 | 10575 | 20 | 3 | ○ | Comparative Example |
| 69 | HW | W | F + γ + M | 45 | 10 | 45 | 1.5 | 2.4 | 761 | 1443 | 5.8 | 8369 | 22 | 3 | ○ | Comparative Example |
| 70 | HX | X | F + γ + M | 62 | 20 | 18 | 1.4 | 2.2 | 634 | 1097 | 17.0 | 18649 | 24 | 7 | ○ | Comparative Example |
| 71 | HX | X | F + γ + M | 55 | 23 | 22 | 1.7 | 2.4 | 679 | 1064 | 18.4 | 19578 | 24 | 3 | ○ | Comparative Example |
| 72 | HX | X | F + γ + M | 52 | 19 | 29 | 1.8 | 2.4 | 699 | 1132 | 16.3 | 18452 | 11 | 6 | ○ | Comparative Example |

*F: Ferrite phase, M: Martensite phase, γ: Retained austenite phase, P: Pearlite, C: Cementite

TABLE 11

| Cold-rolled sheet No. | Hot-rolled sheet No. | Steel No. | Microstructure: Type* | Microstructure fractions (volume %): F | γ | M | Retained γ: Average grain diameter (μm) | Aspect ratio | Tensile properties: YS (MPa) | TS (Mpa) | El (%) | TS × El (Mpa %) | In-plane anisotropy: δTS (Mpa) | δEl (%) | Evaluation | Remark |
|---|---|---|---|---|---|---|---|---|---|---|---|---|---|---|---|---|
| 73 | HY | Y | F + γ + M | 72 | 13 | 15 | 1.5 | 2.1 | 654 | 1194 | 13.9 | 16597 | 9 | 3 | ○ | Comparative Example |
| 74 | HY | Y | F + γ + M | 67 | 8 | 25 | 1.2 | 2.2 | 690 | 1222 | 13.7 | 16741 | 18 | 1 | ○ | Comparative Example |

TABLE 11-continued

| Cold-rolled sheet No. | Hot-rolled sheet No. | Steel No. | Microstructure: Type* | Microstructure fractions (volume %): F | γ | M | Retained γ: Average grain diameter (μm) | Aspect ratio | Tensile properties: YS (MPa) | TS (Mpa) | El (%) | TS × El (Mpa %) | In-plane anisotropy: δTS (Mpa) | δEl (%) | Evaluation | Remark |
|---|---|---|---|---|---|---|---|---|---|---|---|---|---|---|---|---|
| 75 | HY | Y | F + γ + M | 67 | 6 | 27 | 1.3 | 2.5 | 742 | 1255 | 10.5 | 13178 | 8 | 2 | ○ | Comparative Example |
| 76 | HZ | Z | F + γ + M | 55 | 19 | 26 | 1.6 | 2.2 | 713 | 1240 | 10.7 | 13268 | 21 | 5 | ○ | Comparative Example |
| 77 | HZ | Z | F + γ + M | 57 | 23 | 20 | 1.8 | 2.5 | 659 | 960 | 29.4 | 28224 | 15 | 2 | ○ | Comparative Example |
| 78 | HZ | Z | F + γ + M | 56 | 23 | 21 | 1.7 | 2.3 | 688 | 1107 | 18.3 | 20258 | 23 | 7 | ○ | Comparative Example |
| 79 | HAA | AA | F + γ + M | 68 | 8 | 24 | 1.7 | 2.2 | 654 | 1188 | 14.1 | 16751 | 7 | 7 | ○ | Comparative Example |
| 80 | HAA | AA | F + γ + M | 73 | 4 | 23 | 1.9 | 2.8 | 706 | 1193 | 10.7 | 12765 | 14 | 9 | ○ | Comparative Example |
| 81 | HAA | AA | F + γ + M | 70 | 5 | 25 | 1.6 | 2.4 | 775 | 1240 | 8.1 | 10044 | 12 | 5 | ○ | Comparative Example |
| 82 | HAB | AB | F + γ + M | 60 | 19 | 21 | 1.5 | 2.2 | 724 | 1231 | 13.4 | 16495 | 16 | 2 | ○ | Comparative Example |
| 83 | HAB | AB | F + γ + M | 46 | 24 | 30 | 1.9 | 2.3 | 568 | 971 | 30.8 | 29907 | 17 | 1 | ○ | Comparative Example |
| 84 | HAB | AB | F + γ + M | 52 | 21 | 27 | 1.6 | 2.3 | 643 | 1197 | 13.9 | 16638 | 18 | 6 | ○ | Comparative Example |

*F: Ferrite phase, M: Martensite phase, γ: Retained austenite phase, P Pearlite, C: Cementite

TABLE 12

| Cold-rolled sheet No. | Hot-rolled sheet No. | Steel No. | Microstructure: Type* | Microstructure fractions (volume %): F | γ | M | Retained γ: Average grain diameter (μm) | Aspect ratio | Tensile properties: YS (MPa) | TS (Mpa) | El (%) | TS × El (Mpa %) | In-plane anisotropy: δTS (Mpa) | δEl (%) | Evaluation | Remark |
|---|---|---|---|---|---|---|---|---|---|---|---|---|---|---|---|---|
| 85 | HA1 | A | F + γ + M | 62 | 10 | 28 | 2.4 | 2.2 | 710 | 1205 | 13.1 | 15786 | 5 | 4 | ○ | Comparative Example |
| 86 | HA2 | A | F + γ + M | 82 | 5 | 13 | 1.2 | 2.2 | 531 | 845 | 32.0 | 27040 | 12 | 7 | ○ | Comparative Example |
| 87 | HA5 | A | F + γ + M | 59 | 11 | 30 | 2.3 | 1.6 | 658 | 1264 | 10.7 | 13525 | 44 | 21 | X | Comparative Example |
| 88 | HA9 | A | F + γ + M | 68 | 7 | 25 | 2.8 | 1.1 | 515 | 1130 | 15.4 | 17402 | 62 | 16 | X | Comparative Example |
| 89 | HA3 | A | F + γ + M | 55 | 18 | 27 | 2.3 | 1.7 | 682 | 1207 | 14.2 | 17139 | 55 | 20 | X | Comparative Example |
| 90 | HA9 | A | F + γ + M | 56 | 16 | 28 | 2.4 | 1.4 | 631 | 1120 | 13.0 | 14560 | 64 | 14 | X | Comparative Example |
| 91 | HA4 | A | F + γ + M | 73 | 6 | 21 | 1.2 | 2.3 | 520 | 921 | 28.9 | 26617 | 11 | 8 | ○ | Comparative Example |
| 92 | HA0 | A | F + γ + M | 64 | 10 | 26 | 2.3 | 1.4 | 658 | 1080 | 17.8 | 19224 | 37 | 23 | X | Comparative Example |
| 93 | HA2 | A | F + γ + M | 67 | 9 | 24 | 1.1 | 2.7 | 680 | 1214 | 12.0 | 14568 | 18 | 9 | ○ | Comparative Example |
| 94 | HA9 | A | F + γ + M | 66 | 6 | 28 | 3.1 | 1.2 | 734 | 1248 | 9.4 | 11731 | 43 | 13 | X | Comparative Example |
| 95 | HA7 | A | F + γ + M | 82 | 7 | 11 | 1.7 | 2.8 | 537 | 960 | 29.9 | 28704 | 7 | 5 | ○ | Comparative Example |
| 96 | HA4 | A | F + γ + M | 9 | 10 | 81 | 1.6 | 2.4 | 682 | 1290 | 5.2 | 6708 | 8 | 6 | ○ | Comparative Example |
| 97 | HA5 | A | F + γ + M | 12 | 10 | 78 | 1.8 | 1.1 | 647 | 1215 | 8.4 | 10206 | 36 | 18 | X | Comparative Example |
| 98 | HA0 | A | F + γ + M | 82 | 5 | 13 | 0.7 | 2.2 | 540 | 934 | 27.1 | 25311 | 23 | 7 | ○ | Comparative Example |
| 99 | HA8 | A | F + γ + M | 65 | 9 | 26 | 1.3 | 2.4 | 688 | 1213 | 12.4 | 15041 | 16 | 6 | ○ | Comparative Example |

TABLE 12-continued

| Cold-rolled sheet No. | Hot-rolled sheet No. | Steel No. | Microstructure: Type* | Microstructure fractions (volume %): F | γ | M | Retained γ: Average grain diameter (μm) | Aspect ratio | Tensile properties: YS (MPa) | TS (Mpa) | El (%) | TS × El (Mpa %) | In-plane anisotropy: δTS (Mpa) | δEl (%) | Evaluation | Remark |
|---|---|---|---|---|---|---|---|---|---|---|---|---|---|---|---|---|
| 100 | HA6 | A | F + γ + M | 68 | 13 | 19 | 1.4 | 2.7 | 705 | 1204 | 13.0 | 15652 | 20 | 3 | ○ | Comparative Example |
| 101 | HA8 | A | F + γ + M | 74 | 17 | 9 | 2.1 | 1.7 | 512 | 997 | 35.2 | 35094 | 51 | 15 | X | Comparative Example |
| 102 | HA8 | A | F + γ + M | 80 | 19 | 1 | 2.3 | 1.7 | 589 | 1061 | 27.1 | 28753 | 64 | 26 | X | Comparative Example |
| 103 | HA8 | A | F + γ + M | 78 | 17 | 5 | 2.7 | 1.2 | 652 | 1273 | 16.7 | 21259 | 55 | 20 | X | Comparative Example |

*F: Ferrite phase, M: Martensite phase, γ: Retained austenite phase, P: Pearlite, C: Cementite All the thin high-strength cold-rolled steel sheets prepared in the Examples had a microstructure including an appropriate amount of ferrite phase and an appropriate amount of fine and acicular retained austenite phase with the balance including the martensite phase, a high tensile strength TS of 980 MPa or more, and high ductility. Specifically, all the thin high-strength cold-rolled steel sheets prepared in the Examples had a total elongation El of 20% or more when the TS of the steel sheet was the 980 MPa grade, a total elongation El of 15% or more when the TS of the steel sheet was the 1180 MPa grade, and a total elongation El of 10% or more when the TS of the steel sheet was the 1270 MPa grade. Furthermore, all the thin high-strength cold-rolled steel sheets prepared in the Examples had small in-plane anisotropies in terms of strength and elongation. In contrast, the steel sheets prepared in the Comparative Examples failed to have the desired microstructure and, as a result, had an insufficient strength, insufficient ductility, or large in-plane anisotropies.

The production consistency of each steel sheet was evaluated on the basis of the tensile properties of the steel sheet. Specifically, the fluctuations in the tensile strength TS and total elongation El of each of the steel sheets which occurred when the temperature at which the annealing step had been conducted was changed by 20° C. were calculated from the TS and El of the steel sheet. The temperatures in the annealing step which were studied in this evaluation are the annealing temperature T1 and the cooling-end temperature T2 in the first annealing substep and the annealing temperature T3 and the cooling-end temperature T4 in the second annealing sub step.

Specifically, the fluctuations in TS and El were determined from the comparison between the TS values and El values of two cold-rolled steel sheets that had been prepared under the same conditions except that only the temperature Ti in the annealing step was different. The fluctuations (ΔTS and ΔEl) that occurred when the temperature in the annealing step was changed by 20° C. were calculated from the fluctuations in TS and El. The fluctuations (ΔTS and ΔEl) the occurred when the temperature T2, T3, or T4 in the annealing step was changed by 20° C. were also determined as in the case for temperature T1.

Table 13 shows the results.

TABLE 13

| Steel No. | First annealing substep: Annealing temperature T1: ΔTS (Mpa) | ΔEl (%) | Cold-rolled steel sheet Nos.* used for determining fluctuations | Cooling end temperature T2: ΔTS (Mpa) | ΔEl (%) | Cold-rolled steel sheet Nos.* used for determining fluctuations | Second annealing substep: Annealing temperature T3: ΔTS (Mpa) | ΔEl (%) | Cold-rolled steel sheet Nos.* used for determining fluctuations | Cooling end temperature T4: ΔTS (Mpa) | ΔEl (%) | Cold-rolled steel sheet Nos.* used for determining fluctuations | Evaluation | Remark |
|---|---|---|---|---|---|---|---|---|---|---|---|---|---|---|
| A | 12.4 | 0.8 | No. 1 and No. 3 | | | | | | | | | | ○ | Example |
| B | | | | 9.8 | 0.6 | No. 4 and No. 6 | | | | | | | ○ | Example |
| C | | | | | | | 18 | 1.5 | No. 7 and No. 9 | | | | ○ | Example |
| D | | | | | | | | | | 8.4 | 0.7 | No. 10 and No. 12 | ○ | Example |
| E | | | | | | | 8.5 | 1.3 | No. 13 and No. 15 | | | | ○ | Example |
| F | | | | 11.8 | 0.8 | No. 16 and No. 18 | | | | | | | ○ | Example |

TABLE 13-continued

| | Fluctuations per 20° C. of change in temperature in annealing step | | | | | | | | | | | | | |
|---|---|---|---|---|---|---|---|---|---|---|---|---|---|---|
| | First annealing substep | | | | | | Second annealing substep | | | | | | | |
| | Annealing temperature T1 | | | Cooling end temperature T2 | | | Annealing temperature T3 | | | Cooling end temperature T4 | | | | |
| Steel No. | ΔTS (Mpa) | ΔEl (%) | Cold-rolled steel sheet Nos.* used for determining fluctuations | ΔTS (Mpa) | ΔEl (%) | Cold-rolled steel sheet Nos.* used for determining fluctuations | ΔTS (Mpa) | ΔEl (%) | Cold-rolled steel sheet Nos.* used for determining fluctuations | ΔTS (Mpa) | ΔEl (%) | Cold-rolled steel sheet Nos.* used for determining fluctuations | Evaluation | Remark |
| G | 13.6 | 0.44 | No. 19 and No. 21 | | | | | | | | | | ○ | Example |
| H | | | | 22.3 | 1.0 | No. 22 and No. 24 | | | | | | | ○ | Example |
| I | | | | | | | 13.6 | 0.9 | No. 25 and No. 27 | | | | ○ | Example |
| J | | | | | | | | | | 14.6 | 0.9 | No. 28 and No. 30 | ○ | Example |
| K | | | | | | | 17.3 | 1.3 | No. 31 and No. 33 | | | | ○ | Example |
| L | | | | 6.3 | 0.7 | No. 34 and No. 36 | | | | | | | ○ | Example |
| M | 4.6 | 0.7 | No. 37 and No. 39 | | | | | | | | | | ○ | Example |
| N | | | | 22.7 | 2.4 | No. 40 and No. 42 | | | | | | | ○ | Example |
| O | | | | | | | 15.4 | 1.1 | No. 43 and No. 45 | | | | ○ | Example |
| P | | | | | | | | | | 12.9 | 0.3 | No. 46 and No. 48 | ○ | Example |
| Q | | | | | | | 17.2 | 2.1 | No. 49 and No. 51 | | | | ○ | Example |
| R | | | | 2.7 | 1.0 | No. 52 and No. 54 | | | | | | | ○ | Comparative Example |
| S | 15.8 | 0.1 | No. 55 and No. 57 | | | | | | | | | | ○ | Comparative Example |
| T | | | | 9.3 | 1.5 | No. 58 and No. 60 | | | | | | | ○ | Comparative Example |
| U | | | | | | | 16.4 | 1.3 | No. 61 and No. 63 | | | | ○ | Comparative Example |
| V | | | | | | | | | | 15.0 | 0.6 | No. 64 and No. 66 | ○ | Comparative Example |
| W | | | | | | | 12.4 | 0.7 | No. 67 and No. 69 | | | | ○ | Comparative Example |
| X | 27.2 | 0.84 | No. 71 and No. 72 | | | | | | | | | | X | Comparative Example |
| Y | | | | 12.2 | 0.7 | No. 73 and No. 75 | | | | | | | ○ | Comparative Example |
| Z | | | | | | | 112.0 | 7.5 | No. 76 and No. 77 | | | | X | Comparative Example |
| AA | | | | | | | | | | 11.6 | 1.8 | No. 79 and No. 81 | ○ | Comparative Example |
| AB | | | | | | | | | | 104 | 7.0 | No. 82 and No. 83 | X | Comparative Example |
| A | | | | | | | 55.2 | 3.7 | No. 101 and No. 103 | | | | X | Comparative Example |

*See Tables 8 to 12

All the thin cold-rolled steel sheets prepared in the Examples had a TS fluctuation of 25 MPa or less and an El fluctuation of 5% or less per 20° C. of change in temperature. That is, fluctuations in strength and total elongation which occurred when the temperature in the annealing step had been changed were small. This confirms that all the thin cold-rolled steel sheets prepared in the Examples had excellent production consistency. Among the cold-rolled steel sheets prepared in the Comparative Examples, in particular, the cold-rolled steel sheets (Comparative Examples) having a composition in which the Ti or Nb content was below our range had a TS fluctuation exceeding 25 MPa and an El fluctuation exceeding 5% per 20° C. of change in temperature. This confirms that these cold-rolled steel sheets had low production consistency.

As described above, the thin cold-rolled steel sheets prepared in the Examples were thin high-strength cold-rolled steel sheets having a high strength, high ductility, excellent strength-ductility balance, small in-plane anisotropies, and excellent quality consistency.

The invention claimed is:

1. A high-strength cold-rolled steel sheet comprising:

a composition containing, by mass,

C: more than 0.25% and 0.45% or less,

Si: 0.50% to 2.50%,

Mn: 2.00% or more and less than 3.50%,

P: 0.001% to 0.100%,
S: 0.0200% or less,
N: 0.0100% or less,
Al: 0.01% to 0.100%,
and one or two elements selected from
Ti: 0.005% to 0.100% and
Nb: 0.005% to 0.100%,
the balance being Fe and inevitable impurities, and
a microstructure including, by volume, 15% or more and 70% or less ferrite phase and more than 15% and 40% or less retained austenite phase, the balance being 30% or less (not including 0%) martensite phase or including 30% or less (not including 0%) martensite phase and 10% or less (including 0%) pearlite phase and/or carbide, wherein
crystal grains of the retained austenite phase have an average diameter of 2.0 μm or less and an aspect ratio of 2.0 or more,
a tensile strength of the high-strength cold-rolled steel sheet is 980 MPa or more,
an in-plane anisotropy δTS of the high-strength cold-rolled steel sheet in terms of tensile strength defined by Formula (1) below is 25 MPa or less, and
an in-plane anisotropy δEl of the high-strength cold-rolled steel sheet in terms of total elongation defined by Formula (2) below is 10% or less:

$$\delta TS=(TS_L+TS_C-2\times TS_D)/2 \quad (1)$$

where δTS: in-plane anisotropy (MPa) in terms of tensile strength TS, $TS_L$: tensile strength (MPa) in a direction parallel to a rolling direction (L direction), $TS_C$: tensile strength (MPa) in a direction (C direction) perpendicular to the rolling direction, and $TS_D$: tensile strength (MPa) in a direction (D direction) inclined at an angle of 45° with respect to the rolling direction, $$\delta El=(El_L+El_C-2\times El_D)/2 \quad (2)$$

where δEl: in-plane anisotropy (%) in terms of total elongation El, $El_L$: total elongation (%) in a direction parallel to the rolling direction (L direction), $El_C$: total elongation (%) in a direction (C direction) perpendicular to the rolling direction, and $El_D$: total elongation (%) in a direction (D direction) inclined at an angle of 45° with respect to the rolling direction.

2. The high-strength cold-rolled steel sheet according to claim 1, further comprising a plating layer selected from a hot-dip galvanizing layer, a hot-dip galvannealing layer, and an electrogalvanizing layer, the plating layer deposited on a surface of the high-strength cold-rolled steel sheet.

3. The thin high-strength cold-rolled steel sheet according to claim 1, wherein the composition further contains, by mass, one or more groups selected from Groups A to D below:
Group A: one or more elements selected from
B: 0.0001% to 0.0050%,
Cr: 0.05% to 1.00%, and
Cu: 0.05% to 1.00%
Group B: one or two elements selected from
Sb: 0.002% to 0.200% and
Sn: 0.002% to 0.200%
Group C: Ta: 0.001% to 0.100%
Group D: one or more elements selected from
Ca: 0.0005% to 0.0050%,
Mg: 0.0005% to 0.0050%, and
REM: 0.0005% to 0.0050%.

4. The high-strength cold-rolled steel sheet according to claim 3, further comprising a plating layer selected from a hot-dip galvanizing layer, a hot-dip galvannealing layer, and an electrogalvanizing layer, the plating layer deposited on a surface of the high-strength cold-rolled steel sheet.

5. A method of producing the high-strength cold-rolled steel sheet according to claim 1 in which a steel is subjected to a hot-rolling step, a pickling step, a cold-rolling step, and annealing step in this order to form a cold-rolled steel sheet,
wherein the hot-rolling step includes heating the steel and forming the steel into a hot-rolled steel sheet having a predetermined thickness,
the cold-rolling step includes cold-rolling the hot-rolled steel sheet at a rolling reduction of 30% or more to form the hot-rolled steel sheet into a cold-rolled steel sheet having a predetermined thickness,
the annealing step includes first and second annealing treatments,
the first annealing treatment including heating the cold-rolled steel sheet to an annealing temperature of 800° C. to 950° C. and subsequently cooling the cold-rolled steel sheet to a cooling-end temperature of 350° C. to 500° C. at a cooling rate such that an average cooling rate between an annealing temperature and a cooling-end temperature is 5° C./s or more to form the cold-rolled steel sheet into a cold-rolled and annealed steel sheet having a microstructure including a martensite phase and a bainite phase such that a total volume fraction of the martensite phase and the bainite phase is 80% or more, and
the second annealing treatment including heating the cold-rolled and annealed steel sheet to an annealing temperature of 700° C. to 840° C., holding the cold-rolled and annealed steel sheet at 700° C. to 840° C. for 10 to 900 s, subsequently cooling the cold-rolled and annealed steel sheet to a cooling-end temperature range of 350° C. to 500° C. at a cooling rate such that the average cooling rate between the annealing temperature and the cooling-end temperature is 5 to 50° C./s, and holding the thin cold-rolled and annealed steel sheet within the cooling-end temperature range for 10 to 1800 s.

6. The method according to claim 5, wherein, subsequent to the second annealing treatment included in the annealing step, any one of a hot-dip galvanizing treatment, a set of a hot-dip galvanizing treatment and an alloying treatment, and an electrogalvanizing treatment is performed.

7. The method according to claim 5, wherein the composition further contains, by mass, one or more groups selected from Groups A to D below:
Group A: one or more elements selected from
B: 0.0001% to 0.0050%,
Cr: 0.05% to 1.00%, and
Cu: 0.05% to 1.00%
Group B: one or two elements selected from
Sb: 0.002% to 0.200% and
Sn: 0.002% to 0.200%
Group C: Ta: 0.001% to 0.100%
Group D: one or more elements selected from
Ca: 0.0005% to 0.0050%,
Mg: 0.0005% to 0.0050%, and
REM: 0.0005% to 0.0050%.

8. The method according to claim 7, wherein, subsequent to the second annealing treatment included in the annealing step, any one of a hot-dip galvanizing treatment, a set of a hot-dip galvanizing treatment and an alloying treatment, and an electrogalvanizing treatment is performed.

* * * * *